US012302979B2

(12) United States Patent
Carriero et al.

(10) Patent No.: US 12,302,979 B2
(45) Date of Patent: May 20, 2025

(54) FOOTWEAR UPPER HAVING A UNITARY KNIT STRUCTURE AND METHOD OF MANUFACTURING

(71) Applicant: NIKE, Inc., Beaverton, OR (US)

(72) Inventors: Michael A. Carriero, Portland, OR (US); Evan W. Jones, Portland, OR (US); Sanchari Ashishkumar Mahapatra, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/401,914

(22) Filed: Jan. 2, 2024

(65) Prior Publication Data

US 2024/0365915 A1 Nov. 7, 2024

Related U.S. Application Data

(63) Continuation of application No. 18/313,710, filed on May 8, 2023, now Pat. No. 11,896,076.

(60) Provisional application No. 63/500,608, filed on May 7, 2023.

(51) Int. Cl.
*A43B 1/04* (2022.01)
*A43B 23/02* (2006.01)

(52) U.S. Cl.
CPC ..... *A43B 1/04* (2013.01); *A43B 23/0215* (2013.01)

(58) Field of Classification Search
CPC ..... A43B 1/04; A43B 23/0235; A43B 23/024
See application file for complete search history.

(56) References Cited

U.S. PATENT DOCUMENTS 4,133,191 A * 1/1979 Blore ..... D04B 1/104 28/163
4,785,558 A * 11/1988 Shiomura ..... A43B 23/025 66/196
5,896,758 A * 4/1999 Rock ..... D04B 21/04 66/194
7,380,421 B1 * 6/2008 Liu ..... D04B 21/14 66/196
2005/0115284 A1 * 6/2005 Dua ..... A43B 9/00 66/178 R
2005/0193592 A1 * 9/2005 Dua ..... A43B 23/0205 36/45

(Continued)

FOREIGN PATENT DOCUMENTS

JP 4278458 B2 6/2009
WO 2022157875 A1 7/2022

*Primary Examiner* — Megan E Lynch
(74) *Attorney, Agent, or Firm* — Quinn IP Law

(57) ABSTRACT

A footwear upper has a unitary knit structure with a knit outer face layer, a knit inner face layer, and a knit intermediate layer integrally knit to define forefoot, midfoot, and heel regions of the footwear upper. The knit intermediate layer is disposed between the knit outer face layer and the knit inner face layer at a plurality of first zones and absent from or present in a lesser amount or a lesser density in a plurality of second zones, the first zones alternating with the second zones in a longitudinal direction, and the unitary knit structure having a greater modulus of elasticity in the longitudinal direction in the first zones than in the second zones, and a greater breathability in the second zones than in the first zones. A method of manufacturing the footwear upper is disclosed.

19 Claims, 10 Drawing Sheets

(56) References Cited

U.S. PATENT DOCUMENTS

2005/0268497 A1* 12/2005 Alfaro ..... A43B 23/24 36/1
2008/0110049 A1* 5/2008 Sokolowski ..... A43B 23/0235 36/50.1
2012/0233882 A1* 9/2012 Huffa ..... D04B 15/56 36/45
2012/0279260 A1* 11/2012 Dua ..... D04B 21/08 66/171
2013/0160323 A1* 6/2013 Hsiao ..... A43B 3/248 36/45
2013/0269209 A1* 10/2013 Lang ..... A43B 1/04 12/146 C
2014/0196315 A1* 7/2014 Beye ..... D04B 21/20 428/119
2014/0259760 A1* 9/2014 Dojan ..... A43B 1/028 12/146 C
2014/0310984 A1* 10/2014 Tamm ..... A43B 23/0275 36/45
2015/0272274 A1* 10/2015 Berns ..... A43B 23/028 36/84
2015/0289592 A1* 10/2015 Song ..... A43B 1/05 36/47
2016/0135528 A1* 5/2016 Baschak ..... A41C 3/12 2/244
2016/0208421 A1* 7/2016 Baines ..... A43B 23/0265
2017/0211214 A1* 7/2017 Kuo ..... D04B 1/12
2018/0184755 A1* 7/2018 Yumiba ..... D04B 1/108
2018/0199668 A1* 7/2018 Yumiba ..... D04B 7/04
2018/0279720 A1* 10/2018 Iuchi ..... D04B 21/207
2018/0332925 A1* 11/2018 Bailey ..... A43B 17/006
2018/0338563 A1* 11/2018 Moretti Polegato ..... A41D 31/102
2018/0368525 A1* 12/2018 Iuchi ..... B32B 37/1207
2019/0037967 A1* 2/2019 Mcfarland, II ..... D04B 1/10
2019/0223540 A1* 7/2019 Cox ..... A43B 9/00
2020/0022456 A1* 1/2020 Brinkman ..... A43B 1/028
2020/0022457 A1* 1/2020 Oordt ..... A43B 23/24
2020/0063301 A1* 2/2020 Takayama ..... D04B 21/06
2020/0181813 A1* 6/2020 Meir ..... D04B 15/362
2020/0354867 A1* 11/2020 Mueller ..... B68G 7/05
2020/0391476 A1* 12/2020 Rezab ..... B32B 5/26
2021/0298422 A1* 9/2021 Kajiwara ..... A43B 23/022
2021/0368941 A1* 12/2021 Chen ..... A43B 1/0072
2021/0381142 A1* 12/2021 MacGilbert ..... A43B 1/04
2023/0200481 A1* 6/2023 Suzuki ..... A43B 23/088 36/45

* cited by examiner

FOOTWEAR UPPER HAVING A UNITARY KNIT STRUCTURE AND METHOD OF MANUFACTURING

CROSS-REFERENCE TO RELATED APPLICATIONS

This application is a continuation of U.S. Nonprovisional application Ser. No. 18/313,710, filed May 8, 2023, which claims the benefit of priority to U.S. Provisional Application No. 63/500,608, filed May 7, 2023, and each of which is incorporated by reference in its entirety.

TECHNICAL FIELD

The present disclosure generally relates to a footwear upper with a unitary knit structure, and to a method of manufacturing the footwear upper.

BACKGROUND

Footwear typically includes a sole structure configured to be located under a wearer's foot and a footwear upper attached to the sole structure. The footwear upper typically surrounds the sides and top of the foot. The footwear upper functions to maintain the article of footwear on the foot with the sole structure underfoot. Footwear manufacturers strive to create articles of footwear manufacturable in a sustainable and efficient manner.

BRIEF DESCRIPTION OF THE DRAWINGS

The drawings described herein are for illustrative purposes only, are schematic in nature, and are intended to be exemplary rather than to limit the scope of the disclosure.

DESCRIPTION

Figure 1:
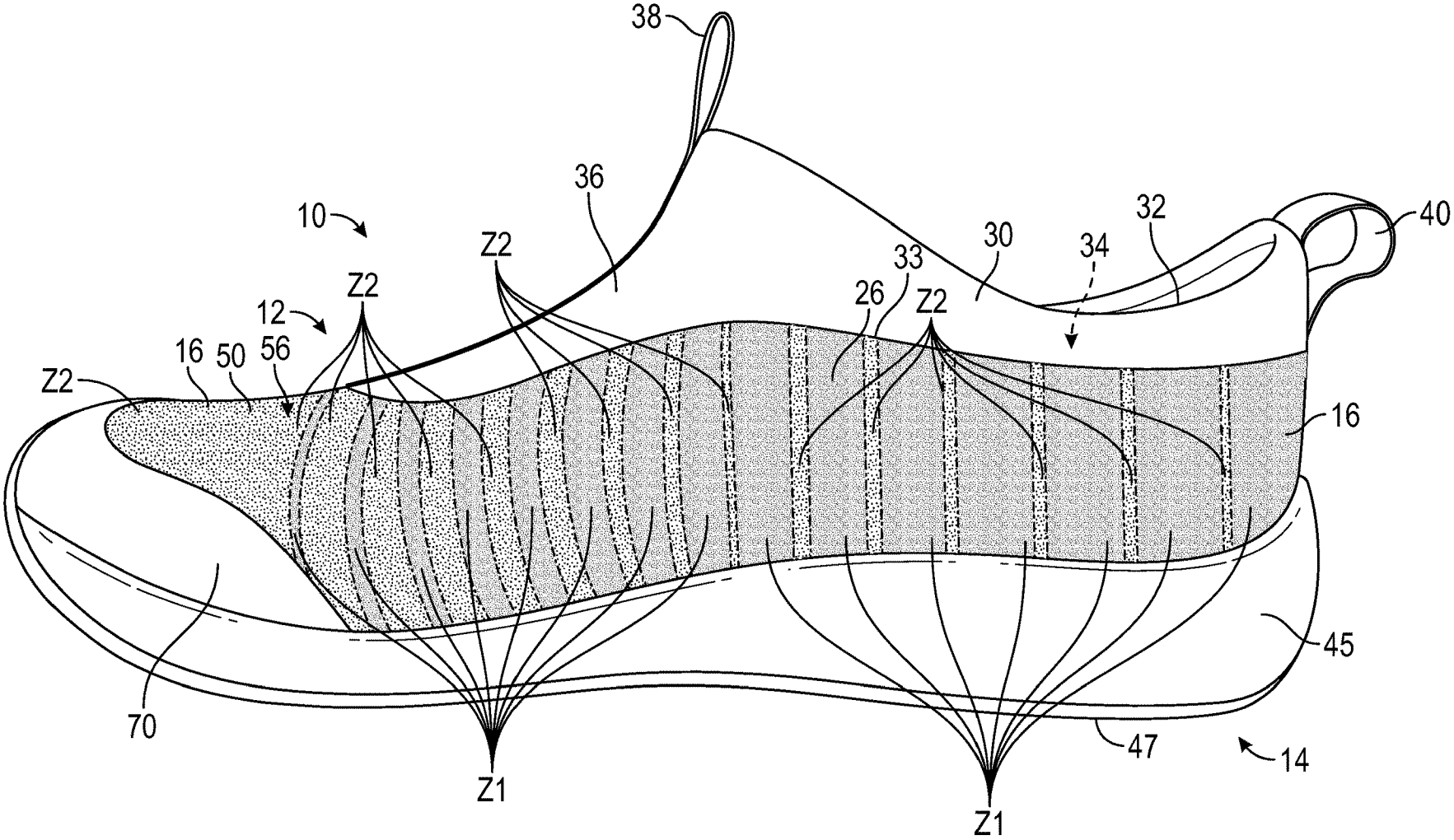
FIG. 1 is a medial side view of an article of footwear with a footwear upper including a unitary knit structure.

The present disclosure generally relates to a footwear upper that includes a unitary knit structure configured with materials selected to provide zones having different functions such as breathability, cushioning, and containment, while advancing sustainability initiatives by being manufacturable with relatively few post-processing steps and with minimal waste.

More specifically, the unitary knit structure has a knit outer face layer, a knit inner face layer, and a knit intermediate layer that are integrally knit with one another to define a forefoot region, a midfoot region, and a heel region of the footwear upper. The knit intermediate layer is disposed between the knit outer face layer and the knit inner face layer and is different at a plurality of first zones of the unitary knit structure than at a plurality of second zones of the unitary knit structure. The knit intermediate layer may be at the plurality of first zones and may be absent from the plurality of second zones, or may be present in both the first zones and the second zones, and in a lesser amount or density in the second zones than in the first zones (e.g., the knit intermediate layer may have a greater density in the first zones than in the second zones), or the first zones may have a greater amount of loft (e.g., cushioning due to height and/or ability to trap air) than the second zones due to the knit intermediate layer). The first zones alternate with the second zones in a longitudinal direction of the footwear upper, which is a direction configured to be a longitudinal direction of an article of footwear when the footwear upper is used in an article of footwear. Due to the differences in the first and second zones with respect to the knit intermediate layer, the unitary knit structure may have a greater modulus of elasticity in the first zones than in the second zones. The footwear upper also may also have greater breathability in the second zones than in the first zones.

In some embodiments, the first zones may have only the knit outer face layer, the knit intermediate layer, and the knit inner face layer (i.e., only three layers) and the second zones may have only the knit outer face layer and the knit inner face layer (i.e., only two layers).

The first and second zones may be strategically placed throughout the footwear upper to best utilize their advantageous features. For example, an average fore-aft width of the first zones in the heel region may be greater than an average fore-aft width of the first zones in the forefoot region. This provides relatively more containment in the heel region than in the forefoot region.

Still further, an average fore-aft width of the second zones in the forefoot region may be greater than an average fore-aft width of the second zones in the heel region. This provides relatively greater breathability in the forefoot region.

The knit inner face layer and the knit outer face layer may be coextensive, one-piece layers, each extending to and defining an entire outer perimeter of the unitary knit structure including a medial edge, a lateral edge, a rear edge, and a front edge and characterized by an absence of sewn seams. In other words, the knit structure itself does not include separate knit pieces sewn together, reducing the number of manufacturing steps in comparison to some footwear uppers.

In some implementations, the first zones progressively increase in fore-aft width in a rearward direction at least from the forefoot region to the midfoot region, and the second zones progressively increase in fore-aft width in a forward direction at least from the midfoot region to the forefoot region.

In an example, the first zones progressively increase in fore-aft width in a rearward direction from the forefoot region to the heel region, and the second zones progressively increase in fore-aft width in a forward direction from the heel region to the forefoot region.

In one or more embodiments, at least a forward half of the forefoot region consists of one of the second zones. This supports ease of movement of a wearer's toes as well as breathability.

In some implementations, boundaries between adjacent ones of the first zones and the second zones may extend substantially linearly in a transverse direction of the footwear upper. Stated differently, each of the zones may be a transversely-extending linear band. This enables the first zones to provide a lockout function around the top and sides of the foot, assisting with containing and stabilizing the foot within the foot-receiving cavity.

The knit configuration of each of the layers may be selected to promote the breathability and containment functions. For example, the knit outer face layer may comprise a mesh pattern including first knitted-in holes of a first size. The knit inner face layer may comprise a mesh pattern including second knitted-in holes of a second size larger than the first size and overlapping with the first knitted-in holes. Stated differently, the knit outer face layer may be knit in a tighter mesh pattern than the knit inner face layer. As such, a surface of the knit outer face layer may be smoother than a surface of the knit inner face layer at each of the first zones and at each of the second zones. A smoother surface functions better as a bonding surface for bonding foam of the sole structure directly to the knit outer face layer than does a surface with a greater variation in topography, for example. This may avoid the need for added components and layers on the surface of the knit outer face layer to accomplish the bonded connection. Accordingly, in an implementation, an article of footwear may include a sole structure directly secured to an outer surface of the knit outer face layer. Additionally, the knit outer face layer, with its smaller openings, functions well to prevent the ingress of dirt.

In one or more embodiments, the first knitted-in holes of the knit outer face layer may each have a first maximum length in the longitudinal direction, and the second knitted-in holes of the knit inner face layer may each have a second maximum length in the longitudinal direction. The second maximum length may be from about two to about four times the first maximum length. Moreover, the second maximum length may be greater than a maximum width of each of the second knitted-in holes. With this elongated shape of the larger second knitted-in holes extending in the longitudinal direction, the modulus of elasticity of the unitary knit structure in the second zones may be greater in the longitudinal direction than in a transverse direction.

The materials selected for the knit layers of the unitary knit structure also promote the functional goals of the footwear upper. For example, the knit outer face layer may comprise one or more monofilament yarns, and the knit inner face layer may comprise one or more multi-filament yarns. In some implementations, the knit outer face layer may consist of the one or more monofilament yarns and/or the knit inner face layer may consist of the one or more multi-filament yarns. Further, in some examples, the knit outer face layer may comprise one or more multi-filament yarns.

By providing one or more monofilament yarns in the knit outer face layer, the abrasion resistance of the footwear upper may be sufficient in many areas without a need to add a skin or film onto the knit outer face layer, and without the need for coated yarns in the knit outer face layer. Typical skins added for abrasion resistance often have multiple layers, including a layer with a thermoset material such as a thermoset polyurethane which does not melt and therefore cannot be recycled using a process which requires melting, making it difficult to recycle a skinned knit structure.

The knit intermediate layer may comprise one or more multi-filament yarns. These may be the same materials as the yarns of the knit inner face layer or may be different yarns.

In an example, the knit inner face layer may comprise one or more multi-filament yarns, including polyester multi-filament yarns, such as recycled drawn polyester multi-filament yarns. In the same example or in a different example, the knit outer face layer may comprise one or more monofilament yarns, including polyester monofilament yarns, such as drawn polyester monofilament yarns.

In an example, the unitary knit structure including the knit inner face layer, the knit outer face layer, and the knit intermediate layer may comprise or consist of thermoplastic yarns, meaning yarns that can be melted and made into new yarns by extrusion or otherwise. In an implementation, the knit outer face layer may comprise monofilament yarns (e.g., drawn polyester monofilament yarns), the knit inner face layer may comprise multi-filament yarns (e.g., drawn polyester multi-filament yarns), and the knit intermediate layer may comprise monofilament or multi-filament yarns, such as polyester monofilament or multi-filament yarns. The knit intermediate layer may comprise dyed yarns, such as cationic dyed polyester yarns. By using a combination of yarns each of which includes a polymeric material consisting of a single class of polymer (e.g., consisting of a thermoplastic polyesters, or consisting of thermoplastic polyamides, etc.) or consisting of a type of polymer (e.g., consisting of thermoplastic polyethelene terephthalate, or consisting of thermoplastic polyamide-11, etc.), all the yarns, and thus the entire knit structure, can be recycled by melting and re-extruding the recycled material, for example, into yarn again, or into pellets.

In a particular implementation, the monofilament yarns of the knit outer face layer may be uncolored (i.e., be substantially free of pigments and dyes), while yarns of the knit intermediate layer, or the yarns of both the knit intermediate layer and the knit inner face layer may be colored (i.e., include pigments and/or dyes). The absence of pigments or dyes from the knit outer face layer results in the knit outer face layer being somewhat transparent, allowing the color of the yarns of the knit intermediate layer to at least partially show through the knit outer face layer in zones where the yarns are present in the unitary knit structure. Stated differently, the knit outer face layer may be more transparent and/or more translucent than the knit inner face layer and/or the knit intermediate layer. In this implementation, the yarns of the knit inner face layer may also be uncolored, or may be pigmented and/or dyed. In zones in which knit intermediate layer is absent or is present but in a lesser amount or density than other zones, using uncolored yarns in the knit outer face layer allows the color (or lack of color) of the yarns in the knit inner face layer to at least partially show through the knit outer face layer. The unitary knit structure may thus be more transparent and/or more translucent at the second zones than at the first zones. By using uncolored yarns in at least the knit outer face layer of the unitary knit structure in combination with colored yarns in either the knit intermediate layer or the knit inner face layer or in both the knit intermediate layer and the knit inner face layer of the unitary knit structure, it is possible to produce a unitary knit structure which has a varied appearance while using fewer colored yarns. Including fewer colored yarns in the footwear upper also increases the recyclability of the upper, as, in order to recycle the yarns, pigments and/or dyes being used to impart color to the yarns may need to be diluted, chemically modified or removed.

The unitary knit structure may be substantially free of a thermoset material (e.g., substantially free of a thermoset skin or substantially free of a thermoset yarn or substantially free of both a thermoset skin and a thermoset yarn, and/or consisting of thermoplastic yarns and substantially free of thermoset yarns, and/or consisting of polymeric materials each having a polymeric component consisting of a single class of polymer (e.g., only polyesters) or a single type of polymer (e.g., only polyethylene terephthalate or only a specific polyamide). This allows any scrap yarn and/or defective knit structures to be easily recycled by melting and re-extruding the melted recycled material, for example, into yarn again. Examples of thermoset materials include thermoset polyurethanes used in skinning materials, and spandex, which is often used to make elasticized yarns. Other materials that are not necessarily recyclable may be utilized in a targeted manner where needed on the footwear upper. For example, the footwear upper may further comprise a textile which comprises a thermoset material, where the textile is fused to or stitched to the unitary knit structure. In one implementation, the thermoset textile is fused to or stitched to the unitary knit structure to define an ankle collar. By fusing or stitching a textile comprising a thermoset material to the unitary knit upper, it is possible to easily separate the thermoset material from the unitary knit upper (e.g., by heating the fused region to debond the fused portion, or by cutting the stitching attaching the thermoset material to the unitary knit upper), allowing the unitary knit structure to be recycled.

In an embodiment, the footwear upper further includes a grip that has a base secured to an outer surface of the knit outer face layer at a tongue portion of the unitary knit structure. The grip also has a protuberance extending outward from the base and having a convex outer surface. At least the protuberance comprises a polyurethane. The grip may thus be fairly soft and flexible so as not to decrease comfort while enabling a wearer to adjust the placement of the tongue portion by grabbing onto and pulling on the grip.

A method of manufacturing the footwear upper may comprise simultaneously knitting a knit outer face layer, a knit inner face layer, and a knit intermediate layer with one another to define a unitary knit structure having a forefoot region, a midfoot region, and a heel region of a footwear upper.

The knit intermediate layer may be disposed between the knit outer face layer and the knit inner face layer at a plurality of first zones and absent from a plurality of second zones. Alternatively, the knit inner face layer may be present in both the first zones and the second zones, and in a greater amount in the first zones than in the second zones (e.g., the knit intermediate layer may have a greater density in the first zones than in the second zones). The first zones may have a greater amount of loft (e.g., cushioning due to height and/or ability to trap air) than the second zones due to the knit intermediate layer). The first zones alternate with the second zones in a longitudinal direction of the article of footwear, and the unitary knit structure has a greater modulus of elasticity in the first zones than in the second zones, and greater breathability in the second zones than in the first zones. The zones, as well as the materials and properties of the knit layers, may be as described herein with respect to the article of footwear.

The method of manufacturing the footwear upper may include fusing or stitching a textile that comprises a thermoset material to the unitary knit structure. For example, the textile may be fused to or stitched to the unitary knit structure to define an ankle collar.

The method of manufacturing the footwear upper may further include cutting an ankle opening in the unitary knit structure beginning at a rear edge of the unitary knit structure and ending at the rear edge of the unitary knit structure.

Moreover, a method of manufacturing an article of footwear including the footwear upper may include securing a sole structure directly to an outer surface of the knit outer face layer along an outer perimeter of the unitary knit structure.

In an example, the unitary knit structure may include a tongue portion, and the method may further comprise securing a grip to an outer surface of the knit outer face layer at the tongue portion. The grip may have a base secured to the outer surface of the knit outer face layer. The grip may also have a protuberance extending outward from the base and having a convex outer surface. At least the protuberance may comprise a polyurethane.

The above features and advantages and other features and advantages of the present teachings are readily apparent from the following detailed description of the modes for carrying out the present teachings when taken in connection with the accompanying drawings. It should be understood that even though in the following the embodiments may be separately described, single features thereof may be combined in additional embodiments.

Figure 2:
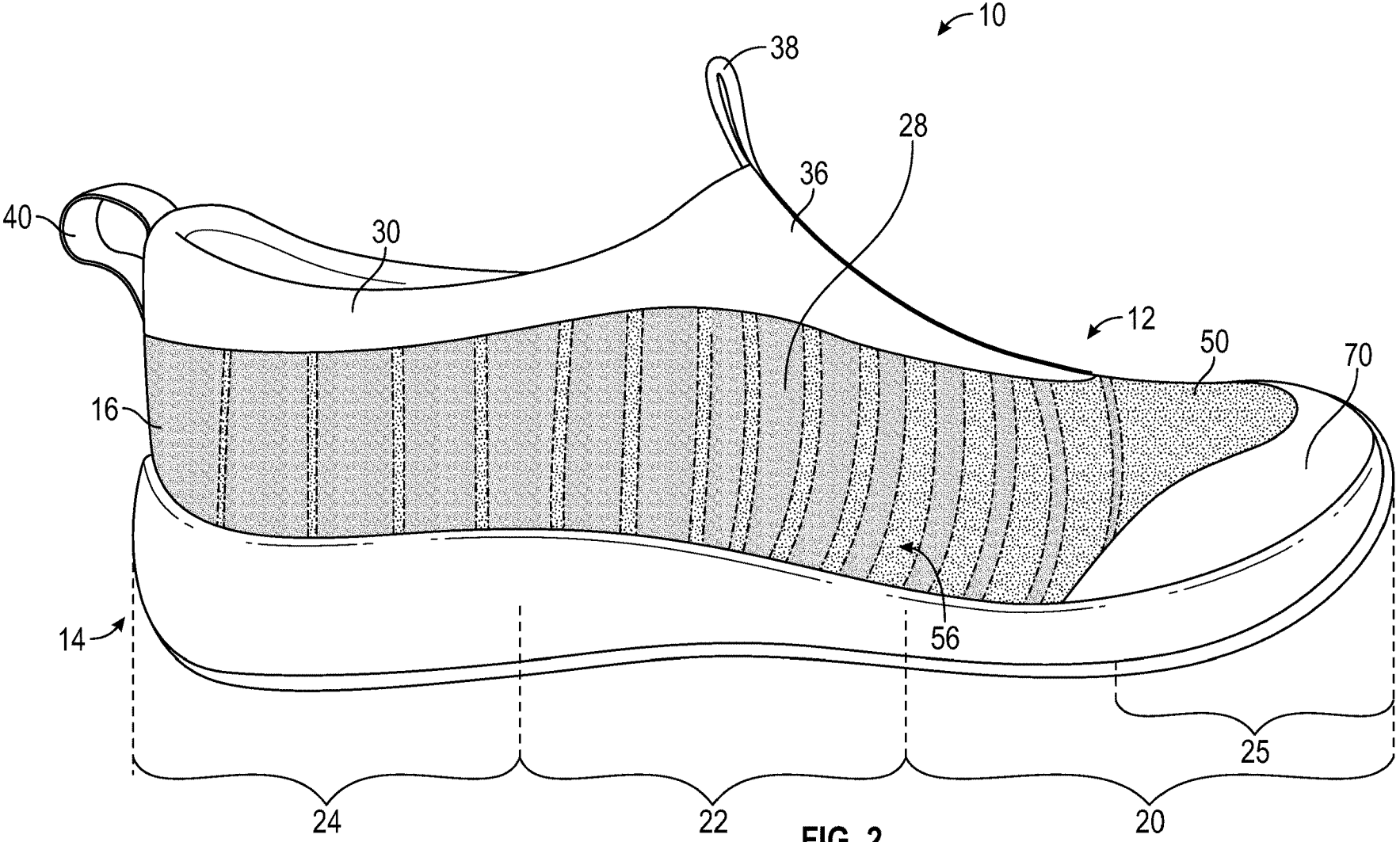
FIG. 2 is a lateral side view of the article of footwear of FIG. 1.
Figure 3:
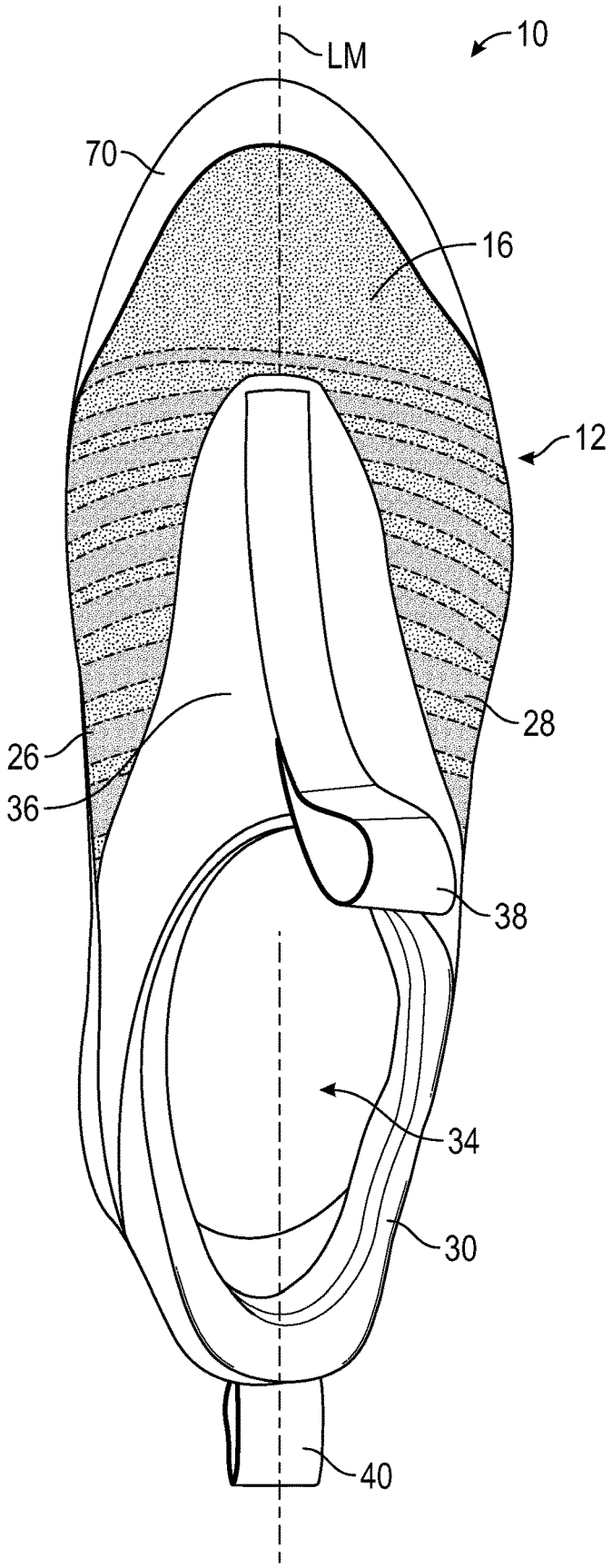
FIG. 3 is a top view of the article of footwear of FIG. 1.

Referring to the drawings, wherein like reference numbers refer to like components throughout the views, FIGS. 1-3 show an article of footwear 10 that includes a footwear upper 12 and a sole structure 14. The footwear upper 12 includes a unitary knit structure 16 described herein that is a one-piece, unitary knit construction. The unitary knit structure 16 may be formed as an integral one-piece element during a single knitting process, such as a warp knitting process, a weft knitting process (e.g., with a flat knitting machine or circular knitting machine), or any other suitable knitting process. That is, the knitting process on the knitting machine may substantially form the unitary knit structure 16 of the footwear upper 12 without the need for additional knitting steps. Accordingly, as utilized herein, a knit structure is defined as being formed of and having a "unitary knit construction" or as being "a unitary knit structure" when formed as a one-piece element through a knitting process. Alternatively, in other embodiments, two or more knit structures may be formed separately as distinct integral one-piece elements and then the respective elements attached.

Other portions of the footwear upper 12 can be joined to each other following the knitting process (e.g., edges of the unitary knit structure 16 can be joined to one another, as at a seam). In various aspects, other elements (e.g., fastening systems, skin(s), a tongue pull, and/or a heel pull) can be added following the knitting process.

With reference to FIG. 2, the article of footwear 10 may be divided into a forefoot region 20, a midfoot region 22, and a heel region 24. The forefoot region 20 generally includes portions of the article of footwear 10 corresponding with the toes and the metatarsophalangeal joints (which may be referred to as MPT or MPJ joints) connecting the metatarsal bones of the foot and the proximal phalanges of the toes. A forward half of the forefoot region 20 may thus be referred to as a toe region 25. The midfoot region 22 generally includes portions of the article of footwear 10 corresponding with the arch area and instep of the foot. The heel region 24 corresponds with rear portions of the foot, including the calcaneus bone. The forefoot region 20, the midfoot region 22, and the heel region 24 are not intended to demarcate precise areas of the article of footwear 10 but are instead intended to represent general areas of the article of footwear 10 to aid in the following discussion. The unitary knit structure 16 of the footwear upper 12 extends in each of the forefoot region 20, the midfoot region 22, and the heel region 24 and the designations of the forefoot region 20, the midfoot region 22, and the heel region 24 of the article of footwear 10 apply equally to the unitary knit structure 16. For example, when the footwear upper 12 is included in the article of footwear 10, the forefoot region 20 of the footwear upper 12 is configured to cover at least a portion of a corresponding forefoot region of a wearer's foot.

The article of footwear 10 has a medial side 26 (indicated in FIG. 1) and a lateral side 28 (indicated in FIG. 2). The medial side 26 and the lateral side 28 extend through each of the forefoot region 20, the midfoot region 22, and the heel region 24, and correspond with opposite sides of the article of footwear 10, each falling on an opposite side of a longitudinal midline (LM) of the article of footwear 10, as indicated in FIG. 3. The medial side 26 is thus considered to be opposite from the lateral side 28. The article of footwear 10 as shown is configured for a right foot. An article of footwear configured for a left foot may be a mirror image of the article of footwear 10.

The footwear upper 12 includes an ankle collar 30 shown stitched to the unitary knit structure 16 to define an ankle opening 32 that opens into a foot-receiving cavity 34 defined by the unitary knit structure 16 over the sole structure 14. The ankle collar 30 may be a textile that comprises a thermoset material, for example. The ankle collar 30 extends to include an integral tongue portion 36. The integral tongue portion 36 may overlay part of the unitary knit structure 16 forward of the ankle collar attachment edge 33 of the unitary knit structure 16 (at which the ankle collar 30 is secured), or a throat opening may be cut in the unitary knit structure 16 to extend forward from the ankle collar attachment edge 33 and the integral tongue portion 36 may be stitched to the throat opening.

A tongue pull 38 is shown secured to the tongue portion 36, and a heel pull 40 is shown secured to a rear of the heel region 24 of the unitary knit structure 16. Each of the tongue pull 38 and the heel pull 40 form a loop for ease of pulling the article of footwear 10 onto a foot. In other embodiments, there may be no tongue pull 38 and/or no heel pull 40. For example, a grip 138 may be provided on a tongue portion 36 in addition to or instead of a tongue pull, as described with respect to FIGS. 13-14.

In FIGS. 1-3, the footwear upper 12 is shown as a sock-like upper. In other embodiments, a fastening system may be utilized to tighten the footwear upper 12 around the foot.

The sole structure 14 may include any or all of an outsole, a midsole, one or more fluid-filled or foam cushioning elements, and one or more plates. Additionally, the sole structure 14 may be equipped with spikes, cleats, or other ground-engaging members. The sole structure 14 is shown as including a midsole 45 and an outsole 47. In other embodiments, the sole structure 14 may be a unisole serving as both a midsole and an outsole, and the sole structure 14 may include outsole components at high wear areas of the sole structure 14.

The midsole 45 may comprise, for example, an elastomeric foam to attenuate ground reaction forces (i.e., provide cushioning) when compressed between the foot and the ground during walking, running, or other ambulatory activities. The midsole 45 may incorporate fluid-filled chambers, plates, moderators, or other elements that further attenuate forces, enhance stability, or influence the motions of the foot.

The elastomeric foam of the midsole 45 may be a unitary foam component (such as a unitary injection-molded foam component) or may be a plurality of fused expanded foam pellets.

The elastomeric foam of the midsole 45 is a foamed polymeric material including one or more polymers. The one or more polymers may include an elastomer, including a thermoplastic elastomer (TPE). The one or more polymers may include aliphatic polymers, aromatic polymers, or mixture of both. In one example, the one or more polymers may include homopolymers, copolymers (including terpolymers), or mixtures of both homopolymers and copolymers. The copolymers may be random copolymers, block copolymers, alternating copolymers, periodic copolymers, or graft copolymers, for instance. The one or more polymers may include polymers chosen from polyolefins, polyacrylates, ionomeric polymers, vinyl polymers, polysiloxanes, fluoropolymers, polystyrenes, polyamides, polyimides, polyesters, polyethers, polyurethanes, and any combination thereof. The one or more polymers may include polymers chosen from polyolefins, polyamides, polyesters, and polyurethanes. Yarns made from polyolefins, polyamides, polyesters and polyurethanes are commonly used in consumer products. The one or more polymers may include polymers chosen from polyamides and polyesters. Polyamides and polyesters are commodity polymers used to make a wide variety of extruded and molded articles, and facilities capable of recycling polyamides and polyesters and extruding the recycled materials into yarns are common. The one or more polymers may include olefinic homopolymers or copolymers or a mixture of olefinic homopolymers and copolymers. Examples of olefinic polymers include polyethylene (PE) and polypropylene (PP). For example, the PE may be a PE homopolymer such as a low-density PE or a high-density PE, a low molecular weight PE or an ultra-high molecular weight PE, a linear PE or a branched chain PE, etc. The PE may be an ethylene copolymer such as, for example, an ethylene-vinyl acetate (EVA) copolymer, an ethylene-vinyl alcohol (EVOH) copolymer, an ethylene-ethyl acrylate copolymer, an ethylene-unsaturated monofatty acid copolymer, etc. The one or more polymers may include a polyacrylate such as a polyacrylic acid, an ester of a polyacrylic acid, a polyacrylonitrile, a polyacrylic acetate, a polymethyl acrylate, a polyethyl acrylate, a polybutyl acrylate, a polymethyl methacrylate, a polyvinyl acetate, etc., including derivatives thereof, copolymers thereof, and any mixture thereof, in one example. The one or more polymers may include an ionomeric polymer. The ionomeric polymer may be a polycarboxylic acid or a derivative of a polycarboxylic acid, for instance. The ionomeric polymer may be a sodium salt, a magnesium salt, a potassium salt, or a salt of another metallic ion. The ionomeric polymer may be a fatty acid modified ionomeric polymer. Examples of ionomeric polymers include polystyrene sulfonate, and ethylene-methacrylic acid copolymers. The one or more polymers may include a polycarbonate. The one or more polymers may include a fluoropolymer. The one or more polymers may include a polysiloxane. The one or more polymers may include a vinyl polymer such as polyvinyl chloride (PVC), polyvinyl acetate, polyvinyl alcohol, etc. The one or more polymers may include a polystyrene. The polystyrene may be a styrene copolymer such as, for example, an acrylonitrile butadiene styrene (ABS), a styrene acrylonitrile (SAN), a styrene ethylene butylene styrene (SEBS), a styrene ethylene propylene styrene (SEPS), a styrene butadiene styrene (SBS), etc. The one or more polymers may include a polyamide (PA). The PA may be a PA 6, PA 66, PA 11, or a copolymer thereof. The polyester may be an aliphatic polyester homopolymer or copolymer such as polyglycolic acid, polylactic acid, polycaprolactone, polyhydroxybutyrate, and the like. The polyester may be a semi-aromatic copolymer such as polyethylene terephthalate (PET) or polybutylene terephthalate (PBT). The one or more polymers may include a polyether such as a polyethylene glycol or polypropylene glycol, including copolymers thereof. The one or more polymers may include a polyurethane, including an aromatic polyurethane derived from an aromatic isocyanate such as diphenylmethane diisocyanate (MDI) or toluene diisocyanate (TDI), or an aliphatic polyurethane derived from an aliphatic isocyanate such as hexamethylene diisocyanate (HDI) or isophone diisocyanate (IPDI), or a mixture of both an aromatic polyurethane and an aliphatic polyurethane.

The foamed polymeric material may be a chemically foamed polymeric material, which is foamed using a chemical blowing agent that forms a gas when heated. For example, the chemical blowing agent can be an azo compound such as adodicarbonamide, sodium bicarbonate, or an isocyanate. Alternatively, or additionally, the foamed polymeric material may be a physically foamed polymeric material, which is foamed using a physical blowing agent which changes phase from a liquid or a supercritical fluid to a gas due to changes in temperature and/or pressure.

Optionally, in addition to the one or more polymers, the foamed polymeric material may further include one or more fillers such as glass fiber, powdered glass, modified or natural silica, calcium carbonate, mica, paper, wood chips, modified or natural clays, modified or unmodified synthetic clays, talc, etc. Similarly, the polymeric material optionally may further include one or more colorants, such as pigments or dyes. Other optional components of the polymeric material include processing aids, ultra-violet light absorbers, and the like.

While the polymeric material which is foamed may start off as a thermoplastic material, in some examples, the polymeric material may be crosslinked during the foaming process or after it has been foamed, resulting in the foamed polymeric material being a crosslinked foamed polymeric material, i.e., a foamed material in which covalent crosslinking bonds exist between at least a portion of the one or more polymers. A crosslinked foamed polymeric material can be formed by including a crosslinking agent in the polymeric material used to form the foam, or by exposing the foamed polymeric material to crosslinking conditions, such as gamma rays. In one example, the crosslinking agent can be a peroxide-based crosslinking agent such as dicumyl peroxide. The foamed polymeric material may be fully thermoset, or may retain some thermoplastic properties so that it can be softened by heat but not fully melt. Alternatively, the foamed polymeric material can be an uncrosslinked foamed polymeric material which remains fully thermoplastic after being foamed. Thermoplastic foamed polymeric materials can be recycled by melting them.

The outsole 47 may be rubber or another material providing traction. In a non-limiting example, the outsole 47 may be formed from materials that may generally include natural or synthetic rubber or other suitably durable materials. The material or materials for the outsole 47 may be selected to provide a desirable combination of durability and flexibility. The outsole rubber may be a thermoset rubber or a thermoplastic rubber. Synthetic rubbers that may be used include polybutadiene rubber, ethylene propylene rubber (EPR), styrene isoprene styrene (SIS) copolymer rubber, and styrene butadiene rubber. Thermoplastic elastomers such as thermoplastic polyurethane elastomers and styrene-ethylene-butadiene-styrene (SEBS) elastomers may also be used for outsole rubber.

The unitary knit structure 16 is multi-functional while maintaining a lightweight and relatively thin construction. As discussed herein, the unitary knit structure 16 achieves this multifunctionality in part by utilizing various interknit layers 50, 52, 54 of different yarn types and/or knit patterns to provide different features as well as zones Z1 and Z2 having different levels of breathability and elasticity (e.g., containment).

Figure 6:
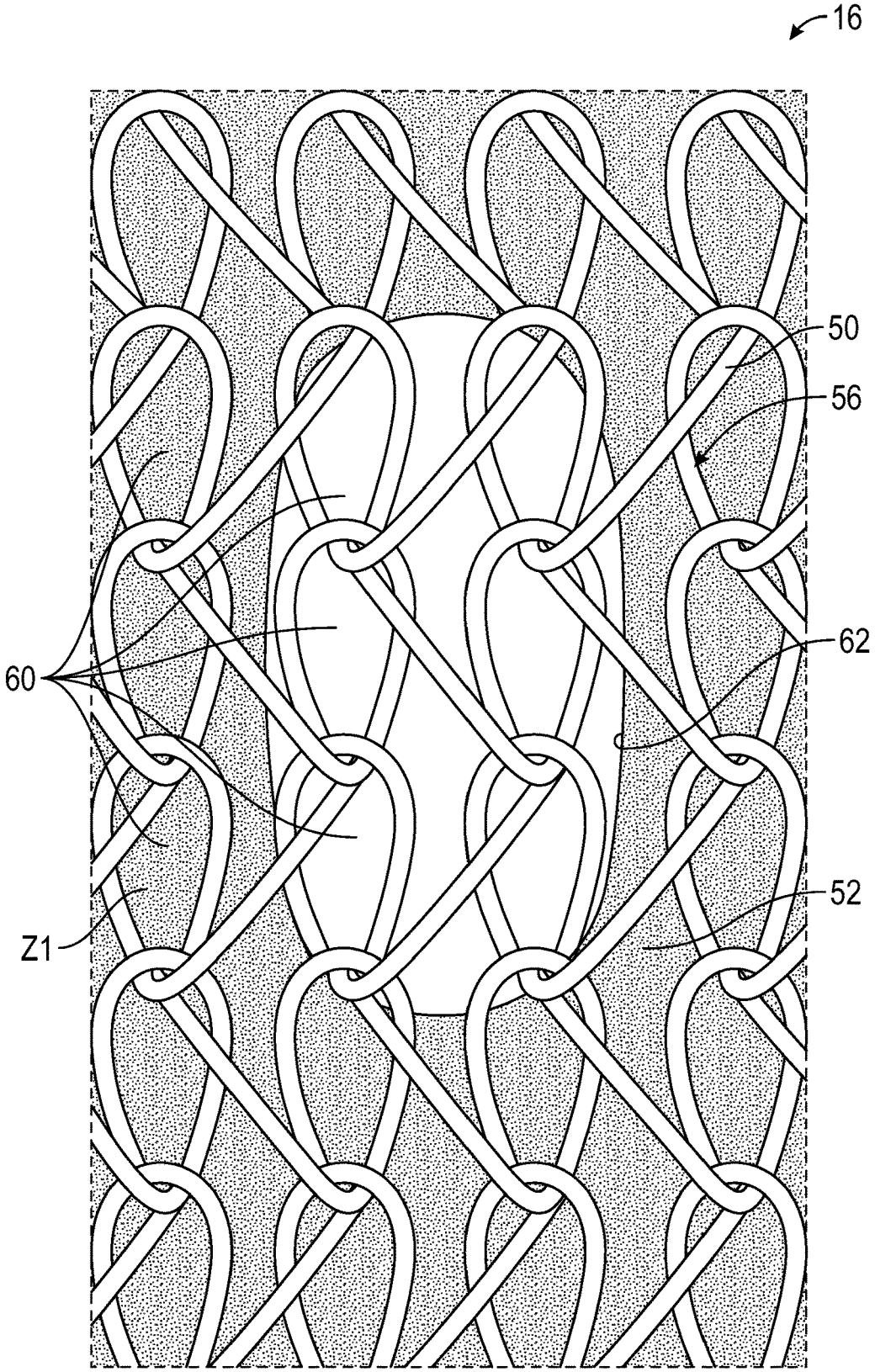
FIG. 6 is a fragmentary close-up plan view of a portion of the outer surface of the unitary knit structure at the knit outer face layer taken at a second zone as indicated in FIG. 4.
Figure 7:
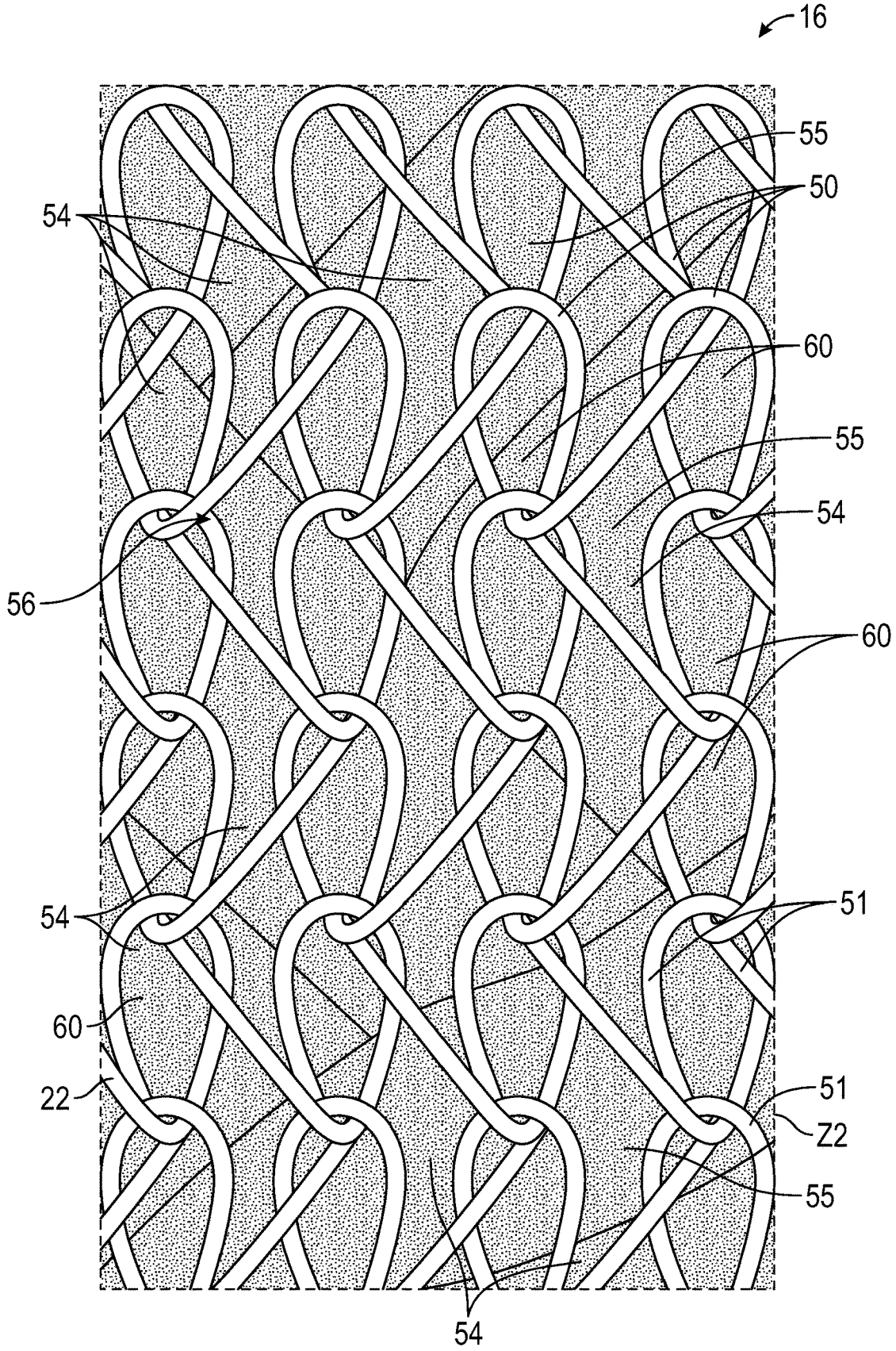
FIG. 7 is a fragmentary close-up plan view of a portion of the outer surface of the unitary knit structure at the knit outer face layer taken at a first zone as shown in FIG. 4.
Figure 8A:
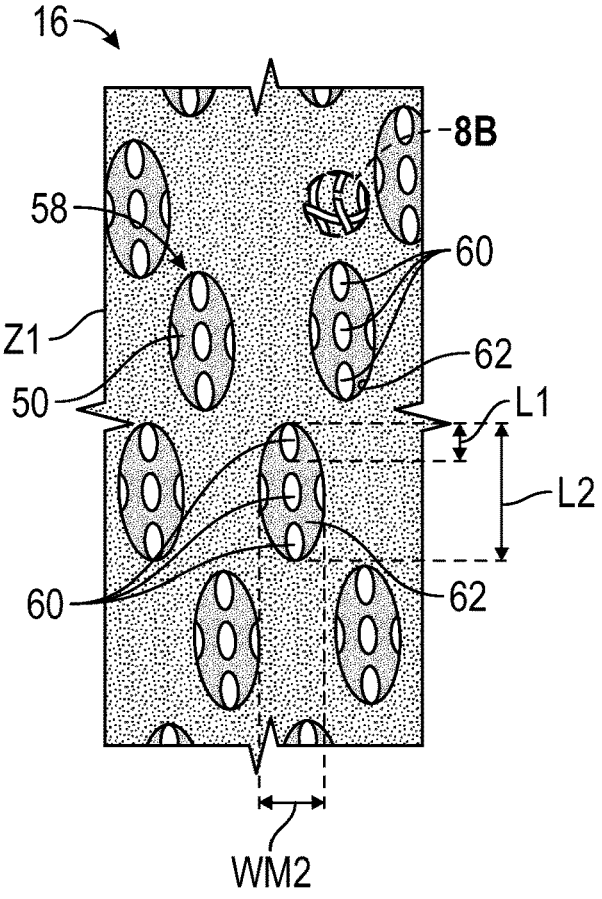
FIG. 8A is a fragmentary close-up plan view of a portion of the inner surface of the unitary knit structure at the knit inner face layer taken at a second zone as shown in FIG. 5.
Figure 9:
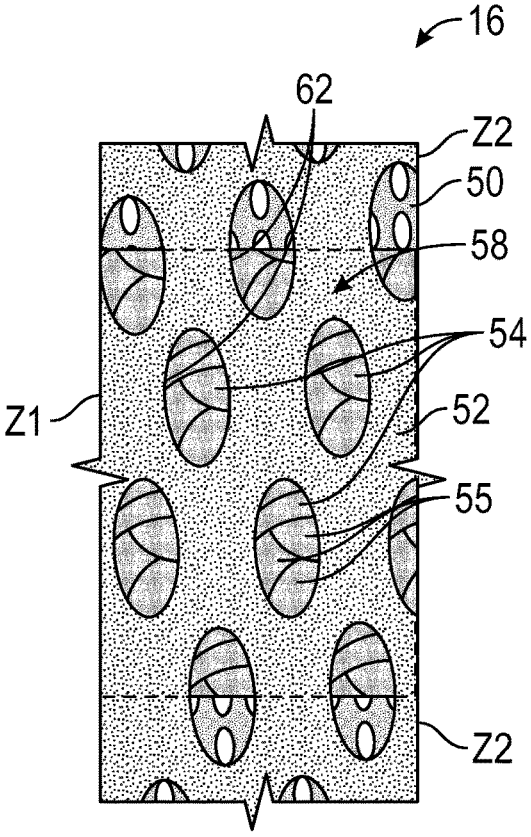
FIG. 9 is a fragmentary close-up plan view of a portion of the inner surface of the unitary knit structure at the knit inner face layer taken at a first zone as shown in FIG. 5.
Figure 10:
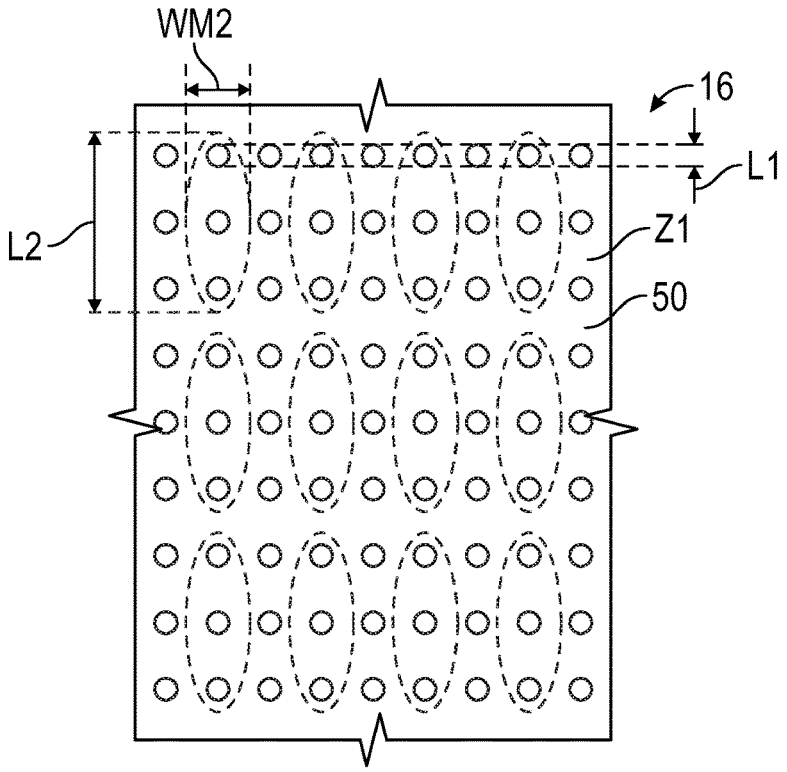
FIG. 10 is a fragmentary close-up plan view of a portion of the outer surface of the unitary knit structure at the knit outer face layer taken at a second zone.
Figure 11:
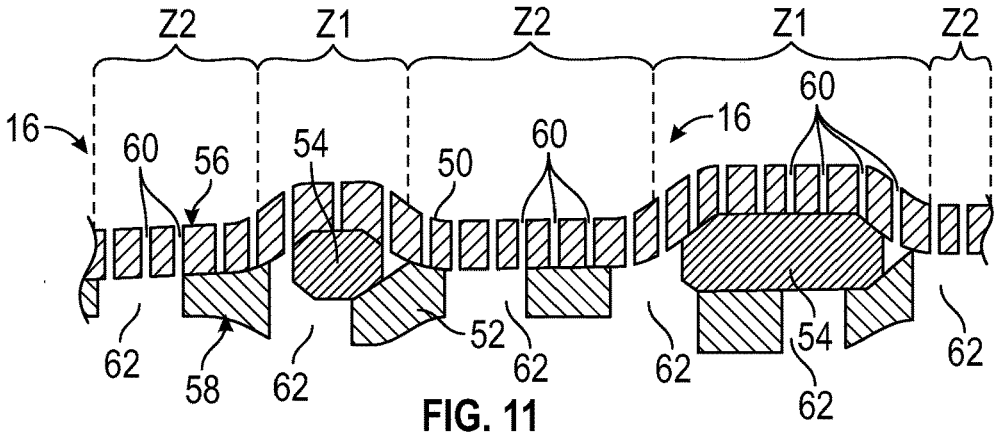
FIG. 11 is a fragmentary cross-sectional view of the unitary knit structure of FIG. 4 taken at lines 11-11 in FIG. 4.

The unitary knit structure 16 includes a knit outer face layer 50 (best shown in FIGS. 1-4, 6-7, and 10-12), a knit inner face layer 52 (best shown in FIGS. 5, 8A, 9, and 11), and a knit intermediate layer 54 (best shown in FIGS. 7, 9, and 11). More specifically, the knit outer face layer 50, the knit inner face layer 52, and the knit intermediate layer 54 are integrally knit with one another to define the forefoot region 20, the midfoot region 22, and the heel region 24 of the footwear upper 12. As such, one or more yarns of the knit outer face layer 50 may be knit with one or more yarns of the knit intermediate layer 54 and or with one or more yarns of the knit inner face layer 52. Likewise, one or more yarns of the knit inner face layer 52 may be knit with one or more yarns of the knit intermediate layer 54 and or with one or more yarns of the knit outer face layer 50.

The knit outer face layer 50 largely defines the outer surface 56 of the unitary knit structure 16, which is the exterior surface or outer side when assembled in the article of footwear 10. The knit inner face layer 52 largely defines the inner surface 58 of the unitary knit structure 16, which is the interior surface or inner side facing the foot-receiving cavity 34 when assembled in the article of footwear 10. In some embodiments, a liner may be added inward of the knit inner face layer 52. In other embodiments, there is no liner, and the inner surface 58 of the knit inner face layer 52 is directly adjacent to the foot.

Because of the mesh structure of both the knit outer face layer 50 and the knit inner face layer 52, in some embodiments, the intermediate layer 54 is exposed at the knitted-in holes 60 and 62 discussed herein and may extend to and thus also form part of the outer surface 56 and the inner surface 58 at the knitted-in holes 60 and 62.

The various zones Z1 and Z2 or parts of the zones of the unitary knit structure 16 may be knitted of yarns comprising different materials or having other different properties, or different combinations of yarns than one another, as discussed herein. The knit intermediate layer 54 is disposed between the knit outer face layer 50 and the knit inner face layer 52 at a plurality of first zones Z1 and is absent from a plurality of second zones Z2 in some embodiments. Where the knit intermediate layer 54 is present (e.g., the first zones Z1 and, in some embodiments, also the second zones Z2), the knit outer face layer 50 and the knit inner face layer 52 are connected with one another such as by intermeshing or interlooping via the knit intermediate layer 54. Where the knit intermediate layer 54 is absent (e.g., the second zones Z2 in some embodiments), the knit outer face layer 50 and the knit inner face layer 52 are connected with one another such as by intermeshing or interlooping (e.g., such that there is not an empty pocket therebetween) and therefore are not movable away from one another. In other embodiments, the knit intermediate layer 54 is present in both the first zones Z1 and the second zones Z2 and in a greater amount in the first zones Z1 than in the second zones Z2. In these embodiments, the knit outer face layer 50 and the knit inner face layer 52 may be connected by the knit intermediate layer 54 in both the first zones Z1 and the second zones Z2 such as by being interlooped or intermeshed via the intermediate layer 54 in both the first zones Z1 and the second zones Z2. The first zones Z1 may have a greater amount of loft and/or may provide greater cushioning than the second zones Z2 due to the different configuration of the knit intermediate layer 54 in the first zones Z1 relative to the second zones Z2. As used herein, the term "loft" may refer to a physical property, aesthetic quality, and/or other characteristic of the unitary knitted structure 16. For example, in some cases, loft may be quantified by physical dimensions, e.g., a distance between the knit outer face layer 50 and the knit inner face layer 52 (a greater distance corresponding with greater loft), a thickness of the unitary knit structure 16 (a greater thickness corresponding with greater loft), a cushioning response of the first zones Z1 relative to the second zones Z2 (a more gradual compression corresponding with greater loft), a density of yarns in the first zones Z1 relative to the second zones Z2 (a greater density corresponding with greater loft), the number of ends (a greater number of ends per unit area corresponding with greater loft), the denier (a greater denier corresponding with greater loft), etc. or a combination thereof, each of which may correspond to the configuration of the knit intermediate layer 54 in the first zones Z1 in comparison to the second zones Z2. As used herein, greater cushioning or a greater cushioning response correlates with lower compressive stiffness. In other words, the first zones Z1 have a first average stiffness and the second zones Z2 have a second average stiffness that is greater than the first average stiffness. "Stiffness" of a zone of the unitary knit structure 16 is the ratio of change in compressive load (e.g., force in Newtons) to displacement of the unitary knit structure 16 (e.g., displacement in millimeters along the axis of the compressive load).

Figure 4:
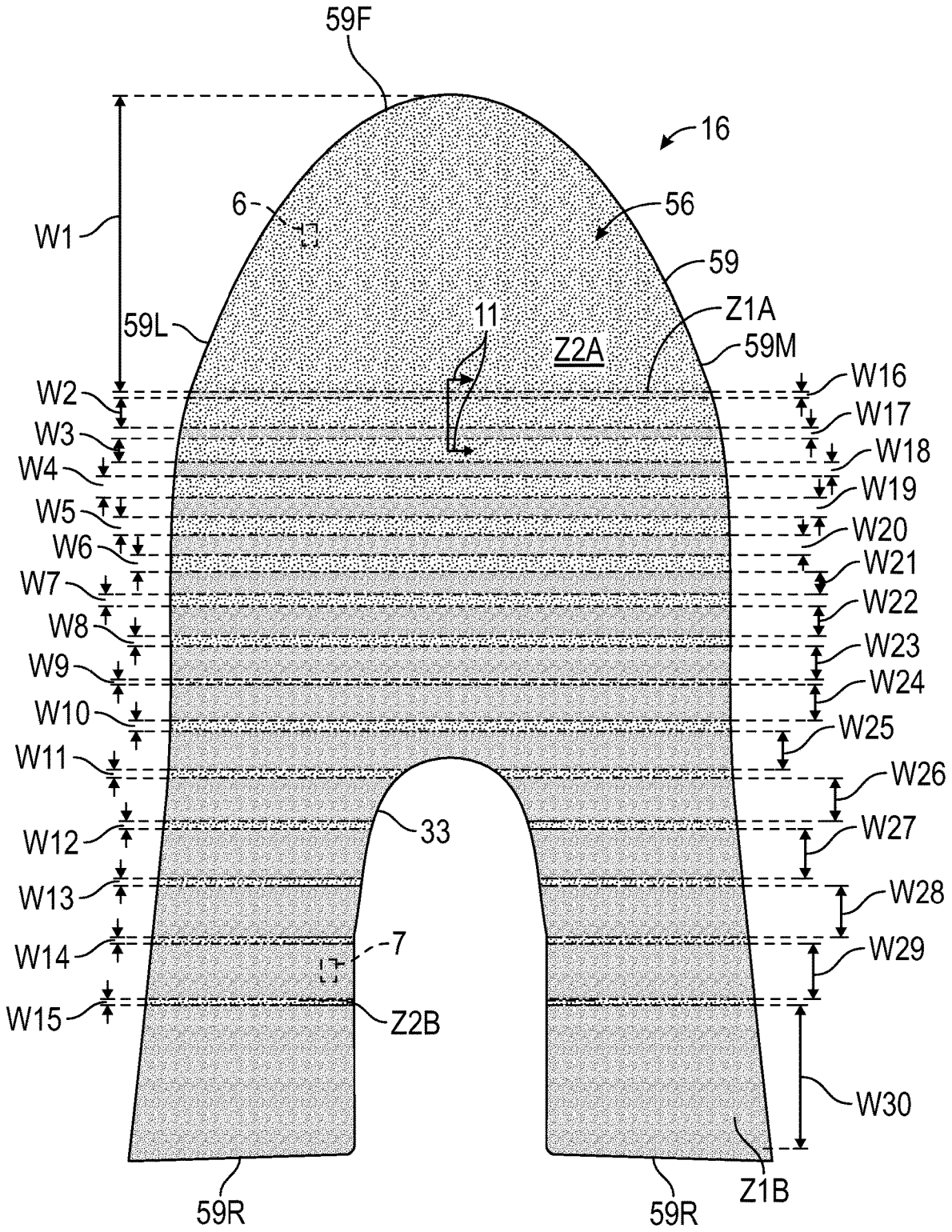
FIG. 4 is a plan view of the unitary knit structure of the footwear upper during manufacture, showing the knit outer face layer.
Figure 5:
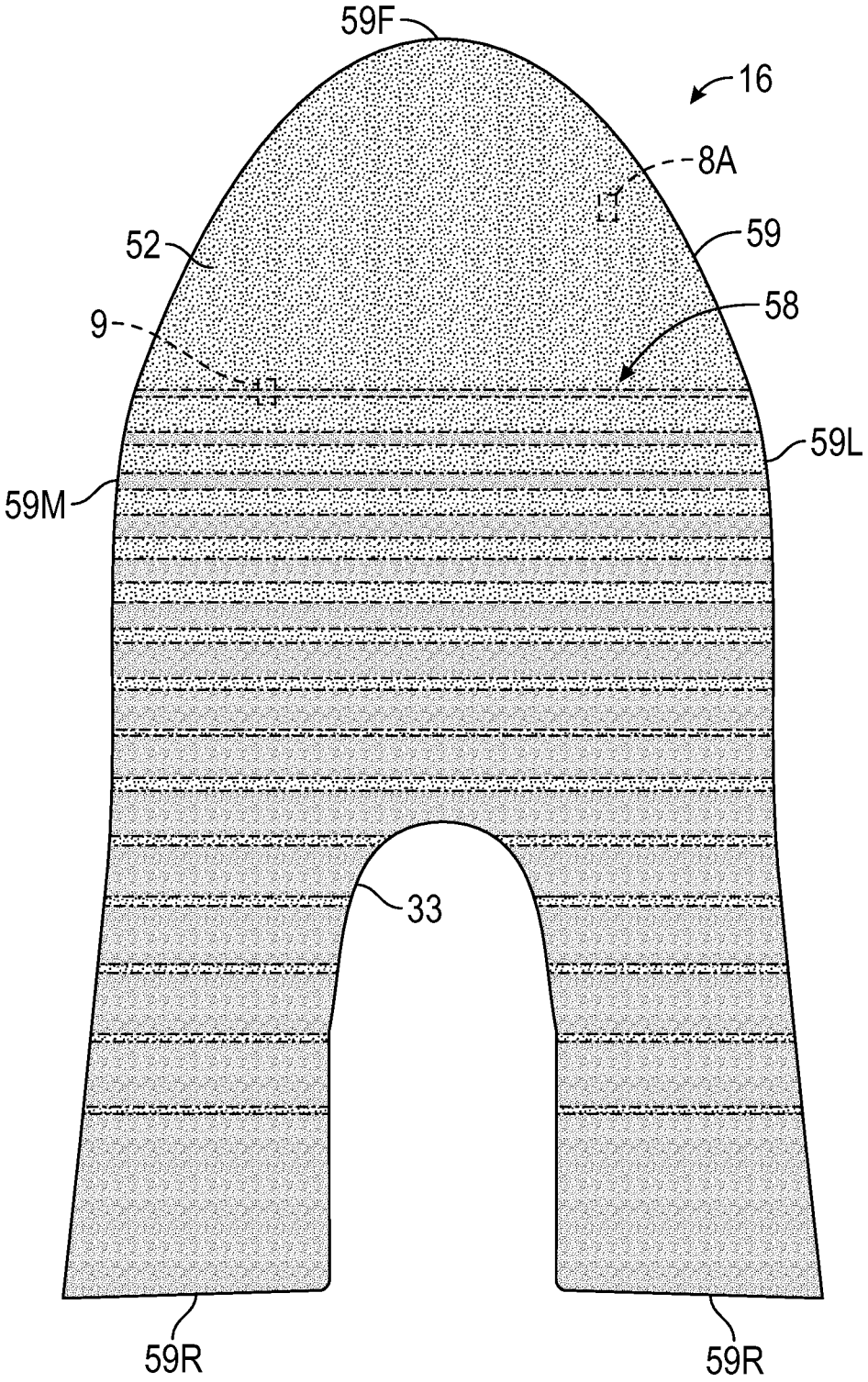
FIG. 5 is a plan view of the unitary knit structure of FIG. 4, showing the knit inner face layer.

In FIGS. 1-5, for clarity in identifying the zones Z1, and Z2, the first zones Z1 are indicated with dot shading that is more dense than dot shading used to identify the second zones Z2. However, the yarns used in the unitary knit structure 16 could be all the same color, or could be different colors, and the zones Z1 could appear lighter, darker, or the same color as the zones Z2. In FIGS. 4 and 5, boundaries between different zones Z1 and Z2 are indicated with phantom lines.

The first zones Z1 alternate with the second zones Z2 in a longitudinal direction of the article of footwear 10 (e.g., along the longitudinal midline LM of FIG. 3). Due to the presence of the knit intermediate layer 54 in the first zones Z1 but not in the second zones Z2 (or at a lesser amount, density, etc. in the second zones Z2), the unitary knit structure 16 has a greater modulus of elasticity in the first zones Z1 than in the second zones Z2. For example, the modulus of elasticity exhibited by the unitary knit structure 16 in the transverse direction in the first zones Z1 may be within a first predefined range of values, and the modulus of elasticity exhibited by the unitary knit structure 16 in the transverse direction in the second zones Z2 may be within a second predefined range of values, for example, with the second predefined range of values being less than the first predefined range of values. The longitudinal direction is a direction along the longitudinal midline LM shown in FIG. 3 (e.g., a fore-aft direction) and the transverse direction is perpendicular to the longitudinal direction.

The unitary knit structure 16 may also have greater breathability in the second zones Z2 than in the first zones Z1. As used herein, "breathability" is a measure of the rate at which water vapor passes through the unitary knit structure 16, referred to as the moisture vapor transmission rate. A "non-breathable" knit structure is a knit structure that exhibits a low rate of moisture vapor transmission. In some exemplary aspects, a knit structure may be defined as being non-breathable when it has a moisture vapor transmission rate less than 1000 ($g/m^2/d$), which is the rate at which water vapor passes through the knit structure, in grams of water vapor per square meter of fabric per 24-hour period ($g/m^2/d$). Accordingly, the moisture vapor transmission rate exhibited by the unitary knit structure 16 is greater in the second zones Z2 than in the first zones Z1 due to the absence of or lesser amount or density of the intermediate layer 54 in the second zones Z2, for example. The moisture vapor transmission rate exhibited by the unitary knit structure 16 in the first zones Z1 may be within a first predefined range of values, and the moisture vapor transmission rate by the unitary knit structure 16 within the second zones Z2 may be within a second predefined range of values, for example, with the second predefined range of values being greater than the first predefined range of values.

In some embodiments, the first zones Z1 may have only the knit outer face layer 50, the knit intermediate layer 54, and the knit inner face layer 52 (i.e., the unitary knit structure 16 may consist of only these three layers in the first zones Z1) and the second zones Z2 may have only the knit outer face layer 50 and the knit inner face layer 52 (i.e., the unitary knit structure 16 may consist of only these two layers in the second zones Z2). Such an embodiment is shown in FIG. 11, for example. With the presence of the intermediate layer 54 at greater amount or density in the first zones Z1 relative to the second zones Z2, the first zones Z1 may be thicker than the second zones Z2 (e.g., have greater loft) and, depending upon the materials used for the intermediate layer 54, can provide greater resistance to stretching and more cushioning than the second zones Z2, as discussed herein.

In some embodiments, an additional spacer layer may be used between the knit outer face layer 50 and the knit inner face layer 52 in the second zones Z2 and/or between the knit outer face layer 50 and the knit intermediate layer 54 in the first zones Z1 and/or between the knit intermediate layer 54 and the knit inner face layer 52 in the first zones Z1.

The first zones Z1 and the second zones Z2 are strategically placed throughout the footwear upper 12 to best confer their advantageous features. For example, an average fore-aft width of the first zones Z1 in the heel region 24 is greater than an average fore-aft width of the first zones Z1 in the forefoot region 20. This provides relatively more containment in the heel region 24 than in the forefoot region 20. Still further, an average fore-aft width of the second zones Z2 in the forefoot region 20 is greater than an average fore-aft width of the second zones Z2 in the heel region 24. This provides relatively greater breathability in the forefoot region 20 than in the heel region 24. In FIG. 4, there are a total of fifteen second zones Z2. The fore-aft widths of the second zones Z2 are labeled W1, W2, W3, W4, W5, W6, W7, W8, W9, W10, W11, W12, W13, W14, and W15 in order from the forefoot region 20 to the heel region 24. It is apparent that at least from the second zone Z2 with the fore-aft width W1 to the second zone Z2 with the fore-aft width W9, the fore-aft widths of the second zones Z2 decrease in a rearward direction from the foremost second zone Z2 (also labeled Z2A in FIG. 4). Alternatively, in the mid-foot and the heel region, the width of the second zones Z2 (that is, the width between two adjacent first zones Z1) may be maintained as a constant width while the widths of the first zones Z1 progressively increase in the rearward direction. The second zones Z2 thus progressively increase in fore-aft width in a forward direction at least in the forefoot region 20 or from the midfoot region 22 to the forefoot region 20. Widths W10, W11, W12, and W13 appear to be slightly greater in fore-aft width than fore-aft width W9. The fore-aft widths of the second zones Z2 then decrease in order from the second zone Z2 with the fore-aft width W10 to the second zone Z2 with the fore-aft width W15, which is the rearmost second zone Z2, also labeled Z2B. In some embodiments, the second zones Z2 progressively increase in fore-aft width in a forward direction from the heel region 24 to the forefoot region 20 (for example, in an embodiment like that of FIG. 4 but in which the fore-aft width W9 is greater than width W10 but still less than width W8). It should be noted that the placement of the zones Z1 and Z2 shown in FIGS. 1-3 is not limiting. For example, the foremost zone Z1 could be further forward or further rearward than shown.

In FIG. 4, there are a total of fifteen first zones Z1. The fore-aft widths of the first zones Z1 are labeled W16, W17, W18, W19, W20, W21, W22, W23, W24, W25, W26, W27, W28, W29, and W30 in order from the forefoot region 20 to the heel region 24. It is apparent that from the first zone Z1 with the fore-aft width W16 to the first zone Z1 with the fore-aft width W30, the fore-aft widths of the first zones Z1 increase from the foremost first zone Z1 (also labeled Z1A in FIG. 4) to the rearmost first zone (also labeled Z1B in FIG. 4). The first zones Z1 thus progressively increase in fore-aft width in a rearward direction at least from the forefoot region 20 to the midfoot region 22, and, in the embodiment shown, from the forefoot region 20 to the heel region 24. In an example, the first zones Z1 in the midfoot region 22 have a lesser average fore-aft width than the first zones Z1 in the heel region 24. In one example, the midfoot region 22 may have a first number of first zones Z1, where each of the first number of first zones Z1 has a first width (e.g., the same width as one another). Further, the heel region 24 may have a second number of first zones Z1, where each of the second number of first zones Z1 has a second width (e.g., the same width as one another). However, the second width of first zones Z1 in the heel region 24 is greater than the first width of the first zones Z1 in the midfoot region 22.

It is apparent from FIGS. 4 and 5 that the knit outer face layer 50 and the knit inner face layer 52 are coextensive, one-piece layers, each extending to and defining an entire outer perimeter 59 of the unitary knit structure 16 including a medial edge 59M, a lateral edge 59L, a rear edge 59R, and a front edge 59F. In some examples where the knit intermediate layer 54 is present in both the first zones Z1 and the second zones Z2, it is also a one-piece layer that is coextensive with the knit outer face layer 50 and the knit inner face layer 52, extending to and also defining the entire outer perimeter 59.

As discussed herein, the outer perimeter 59 may be defined after cutting the unitary knit structure 16 from a larger sheet 72 (see FIG. 12) that includes the unitary knit layers 50, 52, and 54. An ankle collar attachment edge 33 discussed herein may be cut at the same time as cutting the individual knit structures 16A-16J from the sheet 72, or may be cut at the rear edge 59R after cutting the unitary knit structure 16 from the sheet 72.

Furthermore, the knit outer face layer 50 and the knit inner face layer 52 are characterized by an absence of sewn seams. In other words, the unitary knit structure 16 does not include separate knit pieces sewn together, reducing the number of manufacturing steps in comparison to some footwear uppers. Instead, the knit outer face layer 50, the knit inner face layer 52, and the knit intermediate layer 54 are knit simultaneously with one another, (e.g., with a warp knitting machine, a flat knitting machine, a circular knitting machine, or any other suitable knitting process) in one continuous piece without any sewing separately knit pieces to one another.

The knit configuration of each of the layers 50, 52, and 54 may be selected to promote the breathability and containment functions. FIG. 6 is a fragmentary close-up plan view of a portion of the outer surface 56 of the unitary knit structure 16 taken at a second zone Z2 as shown in FIG. 4. FIG. 7 is a fragmentary close-up plan view of a portion of the outer surface 56 of the unitary knit structure 16 taken at a first zone Z1 as shown in FIG. 4. FIG. 8A is a fragmentary close-up plan view of a portion of the inner surface 58 of the unitary knit structure 16 taken at a second zone Z2 as shown in FIG. 5, which may be directly opposite the portion of FIG. 6. FIG. 9 is a fragmentary close-up plan view of a portion of the inner surface 58 of the unitary knit structure 16 taken at a first zone Z1 and showing second zones Z2 bordering the first zone Z1.

Figure 8B:
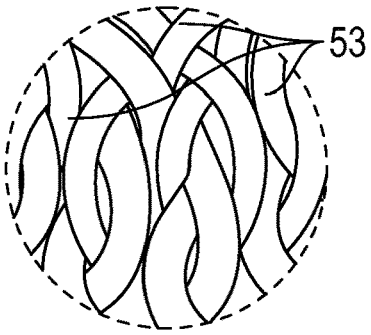
FIG. 8B is a fragmentary close-up view of a portion of the knit inner face layer taken where shown in FIG. 8A.

The knit outer face layer 50 has a mesh pattern including yarns 51 defining first knitted-in holes 60 of a first size, as shown in FIGS. 6 and 7. Only some of the first knitted-in holes 60 are labeled in FIGS. 6 and 7, and are the interior spaces bounded by the looped portions of the yarns 51 comprising the knit outer face layer 50. Only some of the yarns 51 are labelled in FIG. 7. The knit inner face layer 52 also has a mesh pattern including yarns 53 defining second knitted-in holes 62. Individual yarns 53 of the knit inner face layer 52 are depicted in FIG. 8B. Only some of the second knitted-in holes 62 are labeled in FIGS. 8A and 9. The yarns 51 of the knit outer face layer 50 are knit in a tighter mesh pattern than the yarns 53 of the knit inner face layer 52 in the embodiment depicted. The second knitted-in holes 62 are of a second size larger than the first size of the first knitted-in holes 60 and overlap with the first knitted-in holes 60, as shown in FIGS. 6, 8A, 9, and 11. The first size of the first knitted-in holes 60 used in calculating the ratio is an average of the sizes of the first knitted-in holes 60 as there may be some variation in the sizes of the first knitted-in holes 60. Similarly, the second size of the second knitted-in holes 62 used in calculating the ratio is an average of the sizes of the second knitted-in holes 62 as there may be some variation in the sizes of the second knitted-in holes 62.

In other embodiments, the second knitted-in holes 62 may be the same size as or smaller than the first knitted-in holes 60. The ratio of the size of the second knitted-in holes 62 to the size of the first knitted-in holes 60 may also vary in the same region of the unitary knit structure 16 (e.g., in the forefoot region 20) or in different regions (e.g., different ones of the forefoot region 20, the midfoot region 22, and the heel region 24) may have different ratios of the size of the second knitted-in holes 62 to the size of the first knitted-in holes 60.

The larger knitted-in holes 62 may be distributed throughout the knit inner face layer 52 and/or may be localized in certain areas depending on the level of ventilation and/or breathability needed in a certain area. In the embodiment shown, the first knitted-in holes 60 are in the knit outer face layer 50 at the outer surface 56 of the unitary knit structure 16 at both the first zones Z1 and the second zones Z2. The second knitted-in holes 62 are in the knit inner face layer 52 at the inner surface 58 of the unitary knit structure 16 at both the first zones Z1 and the second zones Z2.

In one exemplary aspect, the distribution of the knitted-in holes 62 in the knit inner face layer 52 may be configured such that a majority of the knitted-in holes 62 (e.g., greater than 50%) overlap with the smaller knitted-in holes 60. In other embodiments, a greater or lesser percentage of the knitted-in holes 62 overlap with the knitted-in holes 60. The percentage of knitted-in holes 62 that overlap with knitted-in holes 60 may be the same or may be different in different regions of the unitary knit structure 16.

The size and number of the knitted-in holes 60, 62 may be adjusted to provide different ventilation and breathability characteristics, while still maintaining the structural integrity of the unitary knit structure 16 and maintaining a desired level of thermal insulation. For instance, a larger size and greater number of knitted-in holes 60, 62 in portions of the unitary knit structure 16 may provide a higher degree of ventilation and breathability characteristics to these portions. In another example, a smaller size and a fewer number of knitted-in holes 60, 62 in other portions of the unitary knit structure 16 may provide for a lower degree of ventilation and breathability characteristics. Thus, by adjusting the size and/or number and/or location of the knitted-in holes 60 and/or the knitted-in holes 62, different ventilation and breathability characteristics may be imparted to different portions of the unitary knit structure 16.

With the smaller first knitted-in holes 60 positioned at the outer face layer 50, the ingress of dirt into the unitary knit structure 16 of the footwear upper 12 is less than if the first knitted-in holes 60 were larger in size. For example, larger particles of dirt are prevented from passing through the relatively small first knitted-in holes 60. These same particles of dirt may be able to enter the larger knitted-in holes 62 if those were at the outer face layer 50. By partially shielding the second knitted-in holes 62 with the outer face layer 50 but still overlapping the second knitted-in holes 62 with the first knitted-in holes 60, breathability of the second zones Z2 is achieved with an improved ability to prevent the lodging of dirt in the outer face layer 50 in comparison to uppers with larger mesh openings at the outer face layer.

Additionally, due to the smaller first knitted-in holes 60, the outer surface 56 of the knit outer face layer 50 may be smoother than the inner surface 58 of the knit inner face layer 52 at each of the first zones Z1 and at each of the second zones Z2. As used herein, a smoother surface is a surface having smaller (e.g., less perceptible) projections and indentations. Because the knitted-in holes 60 are smaller than the knitted-in holes 62, the surface 56 appears smoother than the surface 58. Additionally, the smaller knitted-in holes 60 may result in a greater surface area of the outer surface 56 in comparison to a surface area of the inner surface 58. The smoother outer surface 56 functions well as a bonding surface for bonding foam of the sole structure 14 directly to the outer face layer 50, for example, avoiding the need for added components and layers on the surface of the outer face layer 50 to accomplish the bonded connection. With reference to FIGS. 1-2, the sole structure 14 is directly secured to the outer surface 56 of the knit outer face layer 50. For example, a portion of the outer face layer 50 bordering the outer perimeter 59 becomes a lower extent of the footwear upper 12 when incorporated into the article of footwear 10 and may be directly bonded to the midsole 45 during molding of the midsole 45, such as by inserting the lower extent of the unitary knit structure 16 into a mold into which the materials used to form the foam midsole 45 are injected and then cooled to bond to the outer face layer 50.

The size and shape of the knitted-in holes 60, 62 affect both breathability and elasticity of the unitary knit structure 16. The first knitted-in holes 60 of the knit outer face layer 50 may each have a first maximum length L1 in the longitudinal direction (e.g., the direction along the longitudinal midline LM of FIG. 3), and the second knitted-in holes 62 of the knit inner face layer 52 may each have a second maximum length L2 in the longitudinal direction as shown in FIG. 8, for example. Although the relative size of the first knitted-in holes 60 in comparison to the second knitted-in holes 62 is not limited to the example shown, the second maximum length L2 may be from about two to about four times the first maximum length L1. FIGS. 8A and 10 illustrate that three of the first knitted-in holes 60 are easily overlapped by one of the second knitted-in holes 62 and that the ratio of the second maximum length L2 to the first maximum length L1 is approximately four to one. FIG. 10 is taken at the same location as FIG. 6 except shows a larger portion of the unitary knit structure 16 than FIG. 6.

Moreover, the second maximum length L2 may be greater than a maximum width WM2 of each of the second knitted-in holes 62. In other words, the second knitted-in holes 62 are elongated in the longitudinal direction of the unitary knit structure 16 and the footwear upper 12. The first knitted-in holes 60 are also elongated in the longitudinal direction. With the elongated shape of the larger second knitted-in holes 62 as well as the smaller first knitted-in holes 60 extending in the longitudinal direction, the modulus of elasticity of the unitary knit structure 16 in the second zones Z2 may be greater in the longitudinal direction than in a transverse direction. For example, it may be easier to stretch the unitary knit structure 16 by temporarily increasing the width of the first and second knitted-in holes 60, 62 while decreasing their length as a force is applied transversely outward.

The knit outer face layer 50 may be more transparent and/or more translucent than the knit inner face layer 52 and/or the knit intermediate layer 54. Stated differently, the one or more yarns of the knit outer face layer 50 may be more transparent or more translucent than the one or more yarns of the knit inner face layer 52 and/or the one or more yarns of the knit intermediate layer 54. This may enable the knit inner face layer 52 and/or the knit intermediate layer 54 to be visible through the knit outer face layer 50. For example, a person holding the footwear upper 12 or wearing the article of footwear 10 that incorporates the footwear upper 12 may be able to see the knit inner face layer 52 and/or the knit intermediate layer 54 through the knit outer face layer 50. The unitary knit structure 16 may be more transparent and/or more translucent at the second zones Z2 than at the first zones Z1. In embodiments having the first knitted-in holes 60 and the second knitted-in holes 62 as described, the mesh pattern of the knit inner face layer 52 with the larger second knitted-in holes 62 may be visible through the knit outer face layer 50 especially in the second zones Z2 where the knit intermediate layer 54 is absent or present in a lesser amount or density than in the first zones Z1.

In still another example, the knit outer face layer 50 has a first color or hue, and the knit intermediate layer 54 and/or the knit inner face layer 52 has a second color or hue different than the first color or hue. The second color or hue may be darker than the first color or hue and visible through the knit outer face layer 50 due to its greater transparency or translucency.

In a particular implementation, the knit outer face layer 50 may comprise monofilament yarns that are uncolored (i.e., be substantially free of pigments and dyes), while yarns of the knit intermediate layer 54, or the yarns of both the knit intermediate layer 54 and the knit inner face layer 52 are colored (i.e., include pigments and/or dyes). The absence of pigments or dyes from the knit outer face layer 50 results in the knit outer face layer 50 being somewhat transparent, allowing the color of the yarns of the knit intermediate layer 54 and/or the knit inner face layer 52 to at least partially show through the knit outer face layer 50. In this implementation, the yarns of the knit inner face layer 52 may also be uncolored, or may be pigmented and/or dyed. In the second zones Z2 in which knit intermediate layer 54 is absent or present in a lesser amount or density than in the first zones Z1, using uncolored yarns in the knit outer face layer 50 allows the color (or lack of color) of the yarns in the knit inner face layer 52 to at least partially show through the knit outer face layer 50, such as through the first knitted-in holes 60. By using uncolored yarns in at least the knit outer face layer 50 of the unitary knit structure 16 in combination with colored yarns in either the knit intermediate layer 54 or the knit inner face layer 52 or in both the knit intermediate layer 54 and the knit inner face layer 50 of the unitary knit structure 16, it is possible to produce a unitary knit structure 16 which has a varied appearance while using fewer colored yarns. Including fewer colored yarns in the footwear upper 12 also increases the recyclability of the footwear upper 12, as, in order to recycle the yarns, pigments and/or dyes being used to impart color to the yarns may need to be diluted, chemically modified or removed.

Referring again to FIGS. 1-5, it is apparent that boundaries between adjacent ones of the first zones Z1 and the second zones Z2 extend substantially linearly in a transverse direction of the footwear upper 12. The transverse direction is a direction that crosses from the medial side to the lateral side across the longitudinal axis LM, such as a direction perpendicular to the longitudinal midline LM.

More particularly, in the embodiment shown, each of the zones Z1 and Z2 are transversely-extending linear bands. This enables the first zones Z1 to provide a lockout function, assisting with containing the foot within the foot-receiving cavity 34. As discussed above, because stretch at the second zones Z2 may be greater in the transverse direction, by configuring the first zones Z1 to extend transversely from the medial side 26 to the lateral side 28 separating the second zones Z2 from one another, the less stretchable first zones Z1 counter the stretch of the second zones Z2 where desired. For example, by placing wider first zones Z1 in the heel region 24 and the midfoot region 22 and only relatively narrow first zones Z1 in the forefoot region 20, the foot is better held within the foot-receiving cavity 34 at the heel and arch, while flexibility and greater freedom of movement of the toes is provided in the forefoot region 20.

In the embodiment shown, at least a forward half of the forefoot region 20 consists of one of the second zones Z2. More specifically, the forwardmost second zone Z2A extends throughout at least the forward half of the forefoot region 20 (e.g., throughout the toe region 25). This supports ease of movement of a wearer's toes as well as breathability. Additionally, because fewer layers are present in the second zones Z2 than in the first zones Z1, by strategically placing the first zones Z1 only where lockout is needed, less materials are needed and the overall weight of the unitary knit structure 16 is not unnecessarily increased.

The materials selected for the layers 50, 52, and 54 also promote the functional goals of the footwear upper 12. For example, the knit outer face layer 50 may comprise one or more monofilament yarns 51, and the knit inner face layer 52 may comprise one or more multi-filament yarns 53. In some implementations, the knit outer face layer 50 may consist of the one or more monofilament yarns 51 and the knit inner face layer 52 may consist of the one or more multi-filament yarns 53. Further, in some examples, the knit outer face layer 50 may comprise one or more multi-filament yarns.

As used herein, the term "yarn" is understood to refer to a long continuous length of interlocked fibers suitable for use in the production of textiles by hand or by machine, including textiles made using weaving, knitting, crocheting, braiding, sewing, embroidery, or ropemaking techniques. Thread is a type of yarn commonly used for sewing. Types of yarns include continuous filament yarns, examples of which include monofilament yarns (consisting of a single long, continuous filament) and multi-filament yarns (consisting of a plurality of flat or textured filaments which are typically twisted or air-entangled or otherwise grouped with each other). Spun yarns are another type of yarn, which consist of a plurality of staple fibers (such as cotton or wool fibers) or cut fibers or filaments which are entangled with each other in the spinning process to make a cohesive strand. The process of forming a yarn from staple fibers typically includes carding and drawing the fibers to form sliver, drawing out and twisting the sliver to form roving, and spinning the roving to form a strand. Multiple strands can be plied (twisted together) to make a thicker yarn. The twist direction of the staple fibers and of the plies can affect the final properties of the yarn. Spun yarns can contain a single type of fiber, or can be made from a blend of fibers. Once formed, the yarn can undergo further treatment such as dyeing, texturizing, or coating with a material such as a synthetic polymer. Complex yarns are yet another type of yarn, which may consist of a cord or cabled yarn, or which may consist of two or more single yarn strands combined into a ply yarn.

Yarns can be made using fibers formed of natural, regenerated and synthetic materials. Synthetic fibers are generally extruded in continuous strands. The cross-section used to form the extruded strand can affect the properties of the fibers formed. The properties of fibers can also be affected by processes such as drawing (stretching) the fibers, annealing (hardening) the fibers, and/or crimping the fibers. The color of the fibers can be altered by adding pigments or dyes to the material before extrusion, or by dyeing the fibers before or after forming them into yarn. Three basic forms of synthetic fibers are typically used to make yarn: filament; staple (cut) fibers; and tow, which are formed of many filaments loosely joined side by side.

Natural fibers or filaments may be used, including naturally-occurring cellulosic fibers such as cotton or flax, naturally-occurring protein-based fibers or filaments such as wool or silk, and naturally-occurring mineral-based materials such as asbestos. Man-made fibers or filaments may be used, including man-made fibers or filaments made from inorganic materials such as glass or metals, as well as fibers or filaments made from regenerated natural polymers, including cellulose-based polymers and protein-based polymers, man-made carbon fibers or filaments, and man-made fibers or filaments made from synthetic polymers. In many cases, the synthetic polymers are thermoplastics, including thermoplastic elastomers, although thermosets such as elastane may also be used. Synthetic polymers commonly used to make fibers or filaments include polyesters (such as polyethylene terephthalate (PET)), polyamides (such as Nylon-6, Nylon 6,6, and Nylon-11), polyolefins (such as propylene homopolymers and copolymers, as well as ethylene homopolymers and copolymers), and polyacetates (such as cellulose acetate fibers). Polyurethanes, such as thermoplastic polyurethanes, may also be used to make fibers or filaments. The strands may comprise or consist of yarn including natural fibers or filaments, man-made fibers or filaments, or a combination of both natural and man-made fibers or filaments, such as a spun yarn comprising a blend of cotton and polyester fibers. The strands may comprise or consist of a multi-filament yarn comprising polyester or polyamide filaments, such as a commercially available embroidery thread.

The linear mass density or weight per unit length of a yarn can be expressed using various units, including denier (D) and tex. Denier is the mass in grams per 9000 meters. The linear mass density of a single filament of a fiber can also be expressed using denier per filament (DPF). Tex is the mass in grams per 1000 meters; decitex (dtex) is the mass in grams per 10,000 meters.

As used herein, tenacity is understood to refer to the amount of force (expressed in units of weight, for example: pounds, grams, centinewtons or other units) needed to break a yarn (i.e., the breaking force or breaking point of the yarn), divided by the linear mass density of the yarn expressed, for example, in (unstrained) denier, decitex, or some other measure of weight per unit length. The breaking force of the yarn is determined by subjecting a sample of the yarn to a known amount of force, for example, using a strain gauge load cell such as an Instron testing system (Norwood, MA, USA). Yarn tenacity and yarn breaking force are distinct from burst strength or bursting strength of a textile, which is a measure of how much pressure can be applied to the surface of a textile before the surface bursts.

Generally, in order for a yarn to withstand the forces applied in an industrial knitting machine, the minimum tenacity required is approximately 1.5 g/D. Most yarns formed from commodity polymeric materials generally have tenacities in the range of about 1.5 g/D to about 4 g/D. For example, polyester yarns commonly used in the manufacture of knit uppers for footwear have tenacities in the range of about 2.5 to about 4 g/D. Yarns formed from commodity polymeric materials which are considered to have high tenacities generally have tenacities in the range of about 5 g/D to about 10 g/D. For example, commercially available package dyed polyethylene terephthalate yarn from National Spinning (Washington, NC, USA) has a tenacity of about 6 g/D, and commercially available solution dyed polyethylene terephthalate yarn from Far Eastern New Century (Taipei, Taiwan) has a tenacity of about 7 g/D. Yarns formed from high performance polymeric materials generally have tenacities of about 11 g/D or greater. For example, yarns formed of aramid fiber typically have tenacities of about 20 g/D, and yarns formed of ultra-high molecular weight polyethylene (UHMWPE) having tenacities greater than 30 g/D are available from Dyneema (Stanley, NC, USA) and Spectra (Honewell-Spectra, Colonial Heights, VA, USA).

As used herein, a thermoplastic is understood to refer to a polymeric material or a polymer which is a solid when cooled, and which can be repeatedly softened and melted on heating. A thermoset is understood to refer to a polymeric material or a polymer which is a solid at room temperature and which cannot be repeatedly melted on heating, as, on further heating, it decomposes before melting. The term "thermosetting" is understood to refer to a polymeric material or a polymer which initially is flowable but which, once solidified, cannot be repeatedly melted on heating, as, on further heating it decomposed before melting.

The polymeric material may be an elastomeric material, in which the one or more polymers of the elastomeric material comprises, consists essentially of, or consist of one or more elastomers. An elastomer is a polymer having an elongation at break of greater than 100 percent, such as of greater than 200 percent, or of greater than 400 percent, as determined using ASTM D-412-98 at 25 degrees Celsius. An elastomeric material is a composition having an elongation at break of greater than 100 percent, such as of greater than 200 percent, of or greater than 400 percent, as determined using ASTM D-412-98 at 25 degrees Celsius.

By providing one or more monofilament yarns in the knit outer face layer 50, the abrasion resistance of the footwear upper 12 may be sufficient to meet expected needs in many areas without a need to add a skin or film to the unitary knit structure 16 in those areas, and without the need for coated yarns. In the embodiment shown, a skin 70 is shown in FIGS. 1-3 added around a lower extent of the outer face layer 50 in the forefoot region 20.

Minimizing the need for and the use of skins on the footwear upper 12 promotes sustainability goals as skins often have multiple layers, including a layer with a thermoset material such as a thermoset polyurethane which does not melt and therefore is difficult to recycle. For example, skins must often be cut off in order to melt the remaining yarns.

In the example illustrated, the knit inner face layer 52, the knit outer face layer 50, and the knit intermediate layer 54 comprise recyclable yarns. As used herein, a "recyclable" yarn is a yarn that can be processed and reused as a new yarn or other material. For example, melting a yarn and re-extruding the melted material to form a new yarn or otherwise reusing the melted material is one way of recycling a yarn.

For example, the knit outer face layer 50 may comprise or consist of drawn polyester monofilament yarns, the knit inner face layer 52 may comprise or consist of drawn polyester multi-filament yarns, and the knit intermediate layer 54 may comprise or consist of drawn polyester multi-filament yarns. Each of these is recyclable by melting and re-extruding the melted material into yarns, pellets, etc. In one or more other embodiments, the knit outer face layer 50 may comprise or consist of drawn polyester multi-filament yarns.

In an embodiment, the knit intermediate layer 54 comprises cationic dyed polyester yarns 55. Individual yarns 55 of the knit intermediate layer 54 are visible through the outer face layer 50 in FIG. 7 and through the inner face layer 52 in FIG. 9, for example. The yarns 55 appear larger in FIG. 7 than in FIG. 9 because FIG. 7 is a closer view than FIG. 9.

The knit intermediate layer 54 may comprise one or more multi-filament yarns. These may be the same materials as the yarns of the knit inner face layer 52 or may be different materials.

In an example, the knit inner face layer 52 may comprise one or more recycled drawn polyester multi-filament yarns. In the same example or in a different example, the knit outer face layer 50 may comprise one or more drawn polyester monofilament yarns.

The unitary knit structure 16 may be substantially free of thermoset material, as it is in examples that are recyclable by melting and re-extruding the melted material. Other materials that are not necessarily recyclable may be utilized in a targeted manner where needed on the footwear upper 12 while keeping the unitary knit structure 16 recyclable.

For example, the footwear upper 12 shown in FIGS. 1-3 includes the ankle collar 30 secured to the unitary knit structure 16. The ankle collar 30 may include a textile which comprises a thermoset material. The ankle collar 30 could be stitched and/or fused to the unitary knit structure 16.

Figure 12:
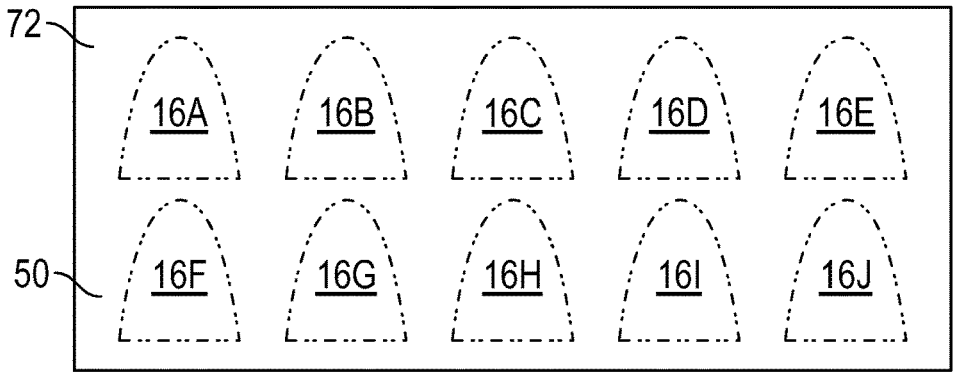
FIG. 12 is a schematic depiction of a sheet knitted with the layers of the unitary knit structure of FIG. 1 prior to cutting out multiple unitary knit structures for articles of footwear.

FIG. 12 is a schematic depiction of a sheet 72 that illustrates another aspect of possible manufacturing efficiencies of the present unitary knit structure 16. The sheet 72 includes larger versions of the outer face layer 50, the inner face layer 52, and the intermediate layer 54. As such, multiple unitary knit structures 16 may be cut from the sheet 72 after simultaneously knitting the layers 50, 52, and 54 of the sheet 72. Multiple unitary knit structures that may be cut from the sheet 72 after the knitting process are depicted with phantom boundaries and are labelled as knit structures 16A, 16B, 16C, 16D, 16E, 16F, 16G, 16H, 16I, and 16J. Although a total of ten knit structures are shown, there could be fewer or more knit structures in a sheet 72.

Additionally, the knit structures could be arranged on the sheet 72 to reduce or minimize spacing therebetween and therearound in order to reduce or minimize scrap areas between and around the knit structure, such as by making the lower edge of each periphery coincident. For example, the lower edges of knit structures 16A and 16F could be coincident by inverting the boundaries of knit structure 16F on the sheet 72 relative to the position shown in FIG. 12. The lower edges of the knit structures 16B and 16G, the lower edges of the knit structures 16C and 16H, the lower edges of the knit structures 16D and 16I, and the lower edges of the knit structures 16E and 16J could likewise be made coincident. In any event, scrap areas between and around the knit structures on the sheet 72 may be fully recyclable such as if the unitary knit structure 16 is free of thermoset material, as discussed herein. An ankle collar attachment edge 33, as shown in FIGS. 4 and 5 and depicted in FIGS. 1-2, can be cut at the rear edge 59R. The ankle collar attachment edge 33 will serve as an ankle opening of the footwear upper 12 in embodiments that do not include a separate ankle collar 30 and will serve as the edge to which the ankle collar 30 is sewed, fused, or otherwise attached to the unitary knit structure 16 in the embodiment shown.

Figure 13:
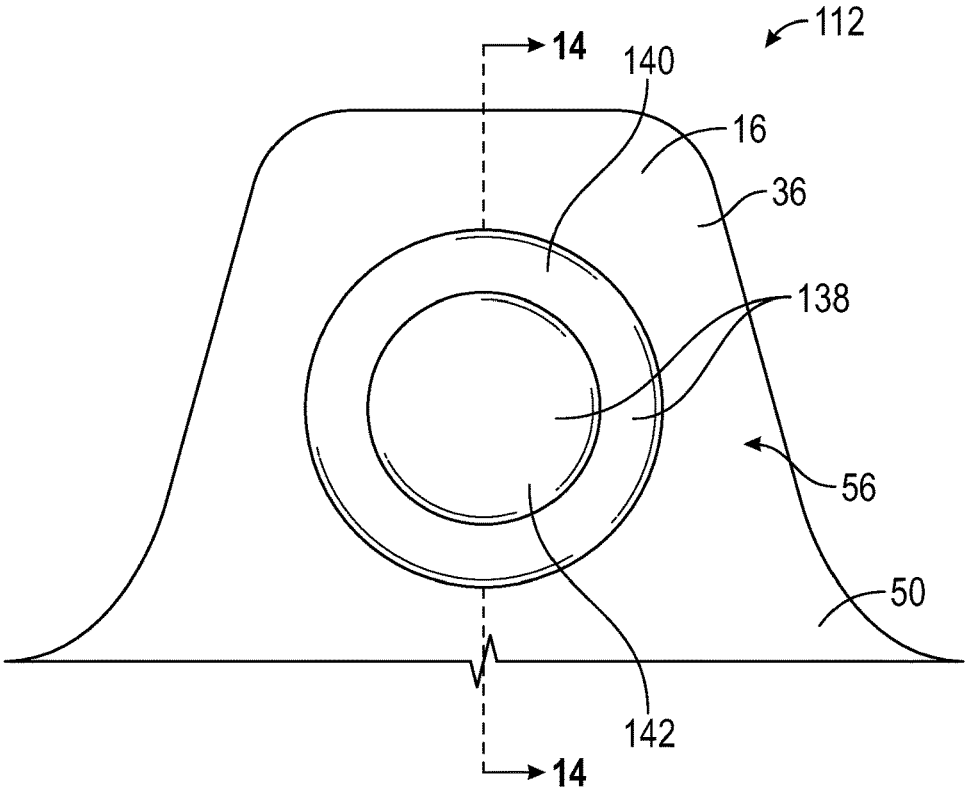
FIG. 13 is a fragmentary view of an alternative embodiment of a footwear upper showing a grip secured to the outer surface of the outer knit layer of a tongue portion of the unitary knit structure.

FIG. 13 is a fragmentary view of an alternative embodiment of a footwear upper 112 that may be used as an alternative to the footwear upper 12 in the article of footwear 10. The footwear upper 112 is alike in all aspects as described herein with respect to the footwear upper 12, including having the same unitary knit structure 16 and tongue portion 36 except that, instead of the tongue pull 38 shown in FIGS. 1-3, the grip 138 is secured to the outer surface 56 of the outer face layer 50 of the tongue portion 36.

Figure 14:
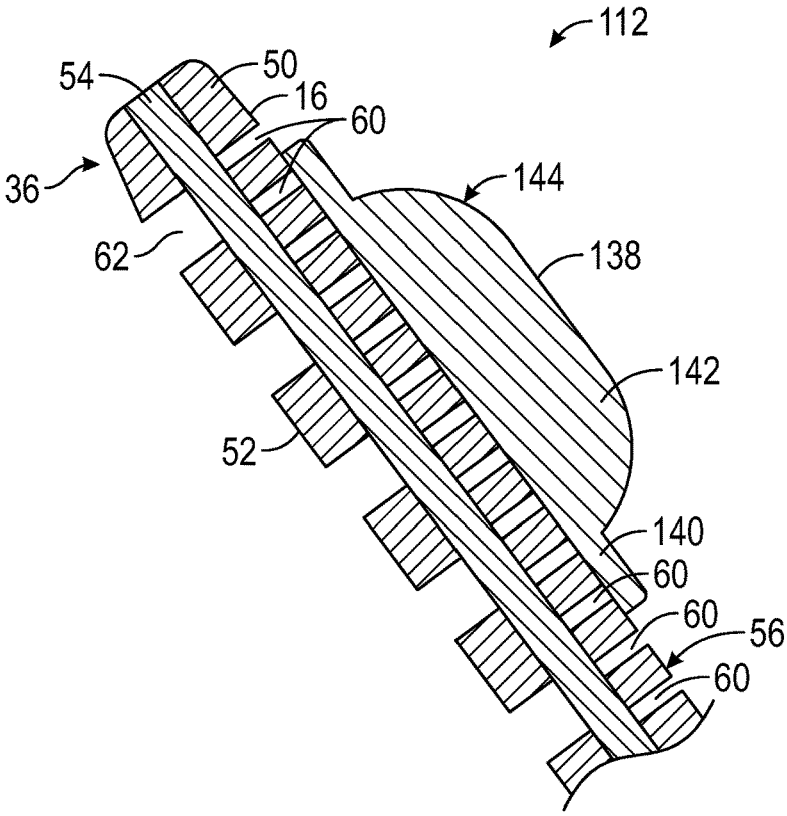
FIG. 14 is a fragmentary cross-sectional view of the tongue portion and grip of FIG. 13 taken at lines 14-14 in FIG. 13.

The grip 138 has a base 140 secured to the outer surface 56 of the knit outer face layer 50 at the tongue portion 36. The grip 138 also includes a protuberance 142 extending outward from the base 140 and having a convex outer surface 144, as best shown in FIG. 14. The unitary knit structure 16 is depicted schematically in FIG. 14 without showing the detail of any of the knitted-in openings or the different zones Z1 and Z2.

At least the protuberance 142 may comprise polyurethane. For example, the protuberance 142 may comprise a polyurethane, such as at an interior of the protuberance. The grip 138 may thus be fairly soft and flexible, so as not to decrease the comfort of the tongue portion 36 and enables a wearer to adjust the placement of the tongue portion 36 by grabbing onto and pulling on the grip 138.

A method of manufacturing a footwear upper 12 such as for an article of footwear 10 discussed herein may include simultaneously knitting a knit outer face layer 50, a knit inner face layer 52, and a knit intermediate layer 54 with one another to define a unitary knit structure 16 having a forefoot region 20, a midfoot region 22, and a heel region 24 of a footwear upper 12. For example, a knitting machine (such as a warp knitting machine, a flat knitting machine, a circular knitting machine) or any other suitable knitting process may simultaneously knit the three layers 50, 52, and 54 with one another.

As discussed herein, the simultaneous knitting may be accomplished such that the knit intermediate layer 54 is disposed between the knit outer face layer 50 and the knit inner face layer 52 at a plurality of first zones Z1 and absent from (or present at a lesser amount or lesser density in) a plurality of second zones Z2, the first zones Z1 alternating with the second zones Z2 in a longitudinal direction of the article of footwear 10, and the unitary knit structure 16 having a greater modulus of elasticity in the longitudinal direction in the first zones Z1 than in the second zones Z2, and having greater breathability in the second zones Z2 than in the first zones Z1. The method may include connecting the knit outer face layer 50 and the knit inner face layer 52 with one another such as by intermeshing or interlooping, which may be via the knit intermediate layer 54. The zones Z1 and Z2 as well as the materials and properties of the knit layers 50, 52, and 54 may be as described herein with respect to the article of footwear 10.

The method of manufacturing may include fusing or stitching a textile that comprises a thermoset material to the unitary knit structure 16. For example, the ankle collar 30 described herein may be fused to or stitched to the unitary knit structure 16 at an ankle collar attachment edge 33 of the unitary knit structure 16 to define an ankle opening 32 as described herein.

The method of manufacturing may include cutting the ankle collar attachment edge 33 in the unitary knit structure 16 beginning at the rear edge 59R of the unitary knit structure 16 and ending again at the rear edge 59R of the unitary knit structure 16.

The method of manufacturing may include securing a sole structure directly to an outer surface of the knit outer face layer along an outer perimeter of the unitary knit structure. For example, the sole structure 14 may be secured directly to the outer surface 56 of the knit outer face layer 50 along the front edge 59F, medial edge 59M, and lateral edge 59L of the outer perimeter 59 as discussed herein.

In an example, the unitary knit structure may include a tongue portion, and the method may further comprise securing a grip to an outer surface of the knit outer face layer at the tongue portion. For example, the grip 138 may be secured to the outer surface 56 of the knit outer face layer 50 at the tongue portion 36 as discussed herein.

The following Clauses provide example configurations of a footwear upper, an article of footwear, and a method of manufacturing an article of footwear as disclosed herein.

Clause 1. A footwear upper comprising: a unitary knit structure, the unitary knit structure having: a knit outer face layer; a knit inner face layer; and a knit intermediate layer; wherein the knit outer face layer, knit inner face layer, and knit intermediate layer are integrally knit with one another to define a forefoot region, a midfoot region, and a heel region of the footwear upper; and wherein the knit intermediate layer is disposed between the knit outer face layer and the knit inner face layer at a plurality of first zones and absent from a plurality of second zones, the first zones alternating with the second zones in a direction of the footwear upper configured to be a longitudinal direction of an article of footwear when the footwear upper is used in an article of footwear, and the unitary knit structure having a greater modulus of elasticity in the longitudinal direction in the first zones than in the second zones and/or greater breathability in the second zones than in the first zones and/or greater loft in the first zones than in the second zones.

Clause 2. The footwear upper of clause 1, wherein: an average fore-aft width of the first zones in the heel region is greater than an average fore-aft width of the first zones in the forefoot region; and an average fore-aft width of the second zones in the forefoot region is greater than an average fore-aft width of the second zones in the heel region.

Clause 3. The footwear upper of clause 1 or 2, wherein boundaries between adjacent ones of the first zones and the second zones extend substantially linearly in a transverse direction of the footwear upper.

Clause 4. The footwear upper of any of clauses 1-3, wherein: the first zones progressively increase in fore-aft width in a rearward direction at least from the forefoot region to the midfoot region; and the second zones progressively increase in fore-aft width in a forward direction at least from the midfoot region to the forefoot region.

Clause 5. The footwear upper of any of clauses 1-4, wherein at least a forward half of the forefoot region consists of one of the second zones.

Clause 6. The footwear upper of any of clauses 1-5, wherein: the knit outer face layer comprises a mesh pattern including first knitted-in holes of a first size; and the knit inner face layer comprises a mesh pattern including second knitted-in holes of a second size larger than the first size and overlapping with the first knitted-in holes.

Clause 7. The footwear upper of clause 6, wherein a surface of the knit outer face layer is smoother than a surface of the knit inner face layer at each of the first zones and at each of the second zones.

Clause 8. The footwear upper of clause 6, wherein: the first knitted-in holes of the knit outer face layer each have a first maximum length in the longitudinal direction; the second knitted-in holes of the knit inner face layer each have a second maximum length in the longitudinal direction; and the second maximum length is from about two to about four times the first maximum length.

Clause 9. The footwear upper of clause 8, wherein the second maximum length is greater than a maximum width of each of the second knitted-in holes such that the modulus of elasticity of the unitary knit structure in the second zones is greater in the longitudinal direction than in a transverse direction.

Clause 10. The footwear upper of any of clauses 1-9, wherein the knit outer face layer comprises one or more monofilament yarns and the knit inner face layer comprises one or more multi-filament yarns.

Clause 11. The footwear upper of clause 10, wherein the knit outer face layer consists of the one or more monofilament yarns and the knit inner face layer consists of the one or more multi-filament yarns.

Clause 12. The footwear upper of clause 10, wherein the knit intermediate layer comprises one or more multi-filament yarns.

Clause 13. The footwear upper of any of clauses 1-12, wherein the knit inner face layer comprises one or more recycled drawn polyester multi-filament yarns.

Clause 14. The footwear upper of clause 12, wherein the knit outer face layer comprises one or more drawn polyester monofilament yarns.

Clause 15. The footwear upper of any of clauses 1-14, wherein the knit inner face layer, the knit outer face layer, and the knit intermediate layer comprise yarns that are recyclable by melting the yarns to form a melted material and re-extruding the melted material.

Clause 16. The footwear upper of any of clauses 1-15, wherein: the knit outer face layer comprises drawn polyester monofilament yarns; the knit inner face layer comprises drawn polyester multi-filament yarns; and the knit intermediate layer comprises cationic dyed polyester yarns.

Clause 17. The footwear upper of any of clauses 1-16, wherein the unitary knit structure is substantially free of a thermoset material.

Clause 18. The footwear upper of clause 17, wherein the footwear upper further comprises: a textile comprising a thermoset material, the textile fused to or stitched to the unitary knit structure.

Clause 19. The footwear upper of clause 18, wherein the textile is fused to or stitched to the unitary knit structure to define an ankle collar.

Clause 20. The footwear upper of any of clauses 1-19, wherein the knit inner face layer and the knit outer face layer are coextensive, one-piece layers, each extending to and defining an entire outer perimeter of the unitary knit structure including a medial edge, a lateral edge, a rear edge, and a front edge and characterized by an absence of sewn seams.

Clause 21. The footwear upper of any of clauses 1-20, wherein the unitary knit structure includes a tongue portion, and the footwear upper further includes: a grip having: a base secured to an outer surface of the knit outer face layer at the tongue portion; and a protuberance extending outward from the base and having a convex outer surface; wherein at least the protuberance comprises polyurethane.

Clause 22. A footwear upper comprising: a unitary knit structure, the unitary knit structure having: a knit outer face layer; a knit inner face layer; and a knit intermediate layer; wherein the knit outer face layer, knit inner face layer, and knit intermediate layer are integrally knit with one another to define a forefoot region, a midfoot region, and a heel region of the footwear upper; and wherein the knit intermediate layer is disposed between the knit outer face layer and the knit inner face layer at least at a plurality of first zones of the unitary knit structure, the first zones alternating with second zones of the unitary knit structure in a direction of the footwear upper configured to be a longitudinal direction of an article of footwear when the footwear upper is used in an article of footwear, and the unitary knit structure having a greater loft in the first zones than in the second zones.

Clause 23. The footwear upper of clause 22, wherein a distance between the knit outer face layer and the knit inner face layer and/or a thickness of the unitary knit structure is greater in the first zones than in the second zones.

Clause 24. The footwear upper of clause 22, wherein a cushioning response of the unitary knit structure is greater in the first zones than in the second zones.

Clause 25. The footwear upper of clause 22, wherein a density of the knit intermediate layer is greater in the first zones than in the second zones.

Clause 26. The footwear upper of clause 22, wherein the knit intermediate layer includes a greater number of yarn ends per unit area in the first zones than in the second zones.

Clause 27. The footwear upper of claim 22, wherein the knit outer face layer and the knit inner face layer are connected in the first zones and the second zones via the intermediate layer.

Clause 28. The footwear upper of claim 22, wherein: an average fore-aft width of the first zones in the heel region is greater than an average fore-aft width of the first zones in the forefoot region; and an average fore-aft width of the second zones in the forefoot region is greater than an average fore-aft width of the second zones in the heel region.

Clause 29. The footwear upper of clause 28, wherein boundaries between adjacent ones of the first zones and the second zones extend substantially linearly in a transverse direction of the footwear upper.

Clause 30. The footwear upper of clause 29, wherein: the first zones progressively increase in fore-aft width in a rearward direction at least from the forefoot region to the midfoot region; and the second zones progressively increase in fore-aft width in a forward direction at least from the midfoot region to the forefoot region.

Clause 31. The footwear upper of clause 22, wherein at least a forward half of the forefoot region comprises one of the second zones.

Clause 32. The footwear upper of clause 22, wherein, in the midfoot region and the heel region, the first zones progressively increase in fore-aft width in a rearward direction and the second zones maintain a constant fore-aft width.

Clause 33. The footwear upper of clause 22, wherein an average fore-aft width of the first zones in the midfoot region is less than an average fore-aft width of the first zones in the heel region.

Clause 34. The footwear upper of clause 22, wherein: a first number of the first zones are in the midfoot region and each are of a first width; a second number of the first zones are in the heel region and each are of a second width greater than the first width.

Clause 35. The footwear upper of clause 22, wherein: the knit outer face layer comprises a mesh pattern including first knitted-in holes of a first size; and the knit inner face layer comprises a mesh pattern including second knitted-in holes of a second size larger than the first size and overlapping with the first knitted-in holes.

Clause 36. The footwear upper of clause 35, wherein a surface of the knit outer face layer is smoother than a surface of the knit inner face layer at each of the first zones and at each of the second zones.

Clause 37. The footwear upper of clause 35, wherein: the first knitted-in holes of the knit outer face layer each have a first maximum length in the longitudinal direction; the second knitted-in holes of the knit inner face layer each have a second maximum length in the longitudinal direction; and the second maximum length is from about two to about four times the first maximum length.

Clause 38. The footwear upper of clause 37, wherein the second maximum length is greater than a maximum width of each of the second knitted-in holes such that the modulus of elasticity of the unitary knit structure in the second zones is greater in the longitudinal direction than in a transverse direction.

Clause 39. The footwear upper of clause 22, wherein the knit outer face layer comprises one or more monofilament yarns and the knit inner face layer comprises one or more multi-filament yarns.

Clause 40. The footwear upper of clause 39, wherein the knit outer face layer consists of the one or more monofilament yarns and the knit inner face layer consists of the one or more multi-filament yarns.

Clause 41. The footwear upper of clause 39, wherein the knit intermediate layer comprises one or more multi-filament yarns.

Clause 42. The footwear upper of clause 22, wherein the knit inner face layer comprises one or more recycled drawn polyester multi-filament yarns.

Clause 43. The footwear upper of clause 42, wherein the knit outer face layer comprises one or more drawn polyester monofilament yarns.

Clause 44. The footwear upper of clause 22, wherein the knit outer face layer comprises one or more multi-filament yarns.

Clause 45. The footwear upper of clause 22, wherein the knit inner face layer, the knit outer face layer, and the knit intermediate layer comprise yarns recyclable by melting the yarns and re-extruding melted material of the melted yarns.

Clause 46. The footwear upper of clause 22, wherein: the knit outer face layer comprises drawn polyester monofilament yarns; the knit inner face layer comprises drawn polyester multi-filament yarns; and the knit intermediate layer comprises cationic dyed polyester yarns.

Clause 47. The footwear upper of clause 22, wherein the unitary knit structure is substantially free of yarn comprising a thermoset material.

Clause 48. A footwear upper comprising: a unitary knit structure, the unitary knit structure having: a knit outer face layer; a knit inner face layer; and a knit intermediate layer; wherein the knit outer face layer, knit inner face layer, and knit intermediate layer are integrally knit with one another to define a forefoot region, a midfoot region, and a heel region of the footwear upper; and wherein the knit intermediate layer is disposed between the knit outer face layer and the knit inner face layer at least at a plurality of first zones of the unitary knit structure, the first zones alternating with second zones of the unitary knit structure in a direction of the footwear upper configured to be a longitudinal direction of an article of footwear when the footwear upper is used in an article of footwear, and the intermediate layer having a greater density in the first zones than in the second zones.

Clause 49. The footwear upper of clause 48, wherein a distance between the knit outer face layer and the knit inner face layer and/or a thickness of the unitary knit structure is greater in the first zones than in the second zones.

Clause 50. The footwear upper of clause 48, wherein a cushioning response of the unitary knit structure is greater in the first zones than in the second zones.

Clause 51. The footwear upper of clause 48, wherein the knit intermediate layer includes a greater number of yarn ends per unit area in the first zones than in the second zones.

Clause 52. The footwear upper of claim 48, wherein the knit outer face layer and the knit inner face layer are connected in the first zones and the second zones via the intermediate layer.

Clause 53. The footwear upper of claim 48, wherein: an average fore-aft width of the first zones in the heel region is greater than an average fore-aft width of the first zones in the forefoot region; and an average fore-aft width of the second zones in the forefoot region is greater than an average fore-aft width of the second zones in the heel region.

Clause 54. The footwear upper of clause 53, wherein boundaries between adjacent ones of the first zones and the second zones extend substantially linearly in a transverse direction of the footwear upper.

Clause 55. The footwear upper of clause 54, wherein: the first zones progressively increase in fore-aft width in a rearward direction at least from the forefoot region to the midfoot region; and the second zones progressively increase in fore-aft width in a forward direction at least from the midfoot region to the forefoot region.

Clause 56. The footwear upper of clause 48, wherein at least a forward half of the forefoot region comprises one of the second zones.

Clause 57. The footwear upper of clause 48, wherein, in the midfoot region and the heel region, the first zones progressively increase in fore-aft width in a rearward direction and the second zones maintain a constant fore-aft width.

Clause 58. The footwear upper of clause 48, wherein an average fore-aft width of the first zones in the midfoot region is less than an average fore-aft width of the first zones in the heel region.

Clause 59. The footwear upper of clause 48, wherein: a first number of the first zones are in the midfoot region and each are of a first width; a second number of the first zones are in the heel region and each are of a second width greater than the first width.

Clause 60. The footwear upper of clause 48, wherein: the knit outer face layer comprises a mesh pattern including first knitted-in holes of a first size; and the knit inner face layer comprises a mesh pattern including second knitted-in holes of a second size larger than the first size and overlapping with the first knitted-in holes.

Clause 61. The footwear upper of clause 60, wherein a surface of the knit outer face layer is smoother than a surface of the knit inner face layer at each of the first zones and at each of the second zones.

Clause 62. The footwear upper of clause 60, wherein: the first knitted-in holes of the knit outer face layer each have a first maximum length in the longitudinal direction; the second knitted-in holes of the knit inner face layer each have a second maximum length in the longitudinal direction; and the second maximum length is from about two to about four times the first maximum length.

Clause 63. The footwear upper of clause 62, wherein the second maximum length is greater than a maximum width of each of the second knitted-in holes such that the modulus of elasticity of the unitary knit structure in the second zones is greater in the longitudinal direction than in a transverse direction.

Clause 64. The footwear upper of clause 48, wherein the knit outer face layer comprises one or more monofilament yarns and the knit inner face layer comprises one or more multi-filament yarns.

Clause 65. The footwear upper of clause 64, wherein the knit outer face layer consists of the one or more monofilament yarns and the knit inner face layer consists of the one or more multi-filament yarns.

Clause 66. The footwear upper of clause 64, wherein the knit intermediate layer comprises one or more multi-filament yarns.

Clause 67. The footwear upper of clause 48, wherein the knit inner face layer comprises one or more recycled drawn polyester multi-filament yarns.

Clause 68. The footwear upper of clause 67, wherein the knit outer face layer comprises one or more drawn polyester monofilament yarns.

Clause 69. The footwear upper of clause 48, wherein the knit outer face layer comprises one or more multi-filament yarns.

Clause 70. The footwear upper of clause 48, wherein the knit inner face layer, the knit outer face layer, and the knit intermediate layer comprise yarns recyclable by melting the yarns and re-extruding melted material of the melted yarns.

Clause 71. The footwear upper of clause 48, wherein: the knit outer face layer comprises drawn polyester monofilament yarns; the knit inner face layer comprises drawn polyester multi-filament yarns; and the knit intermediate layer comprises cationic dyed polyester yarns.

Clause 72. The footwear upper of clause 48, wherein the unitary knit structure is substantially free of yarn comprising a thermoset material.

Clause 73. A footwear upper comprising: a unitary knit structure, the unitary knit structure having: a knit outer face layer; a knit inner face layer; and a knit intermediate layer; wherein the knit outer face layer, knit inner face layer, and knit intermediate layer are integrally knit with one another; wherein the knit intermediate layer is disposed between the knit outer face layer and the knit inner face layer; and wherein the knit outer face layer is more transparent and/or more translucent than the knit inner face layer and/or the knit intermediate layer.

Clause 74. The footwear upper of clause 73, wherein knit inner face layer and/or the knit intermediate layer are visible through the knit outer face layer.

Clause 75. The footwear upper of clause 73, wherein: the knit outer face layer comprises a mesh pattern including first knitted-in holes of a first size; and the knit inner face layer comprises a mesh pattern including second knitted-in holes of a second size larger than the first size and overlapping with the first knitted-in holes.

Clause 76. The footwear upper of clause 75, wherein the mesh pattern of the second knitted-in holes is visible through the knit outer face layer.

Clause 77. The footwear upper of clause 73, wherein: the knit outer face layer has a first color or hue; and at least one of the knit intermediate layer or the knit inner face layer has a second color or hue different than the first color or hue.

Clause 78. The footwear upper of clause 77, wherein the second color or hue is darker than the first color or hue and is visible through the knit outer face layer.

Clause 79. The footwear upper of clause 73, wherein each of the knit outer face layer, the knit intermediate layer, and the knit inner face layer extend in and define a forefoot region, a midfoot region, and a heel region of the footwear upper Clause 80. The footwear upper of clause 73, wherein the knit intermediate layer is disposed between the knit outer face layer and the knit inner face layer at least at a plurality of first zones of the unitary knit structure, the first zones alternating with second zones of the unitary knit structure in a direction of the footwear upper configured to be a longitudinal direction of an article of footwear when the footwear upper is used in an article of footwear, and the intermediate layer absent from the second zones or present in a lesser amount in the second zones than in the first zones such that the unitary knit structure has a greater modulus of elasticity in the longitudinal direction in the first zones than in the second zones and/or has greater breathability in the second zones than in the first zones and/or has greater loft in the first zones than in the second zones.

Clause 81. The footwear upper of claim 80, wherein the knit outer face layer and the knit inner face layer are connected in the first zones and the second zones via the intermediate layer.

Clause 82. The footwear upper of claim 80, wherein: an average fore-aft width of the first zones in the heel region is greater than an average fore-aft width of the first zones in the forefoot region; and an average fore-aft width of the second zones in the forefoot region is greater than an average fore-aft width of the second zones in the heel region.

Clause 83. The footwear upper of clause 82, wherein boundaries between adjacent ones of the first zones and the second zones extend substantially linearly in a transverse direction of the footwear upper.

Clause 84. The footwear upper of clause 83, wherein: the first zones progressively increase in fore-aft width in a rearward direction at least from the forefoot region to the midfoot region; and the second zones progressively increase in fore-aft width in a forward direction at least from the midfoot region to the forefoot region.

Clause 85. The footwear upper of clause 80, wherein at least a forward half of the forefoot region comprises one of the second zones.

Clause 86. The footwear upper of clause 80, wherein, in the midfoot region and the heel region, the first zones progressively increase in fore-aft width in a rearward direction and the second zones maintain a constant fore-aft width.

Clause 87. The footwear upper of clause 80, wherein an average fore-aft width of the first zones in the midfoot region is less than an average fore-aft width of the first zones in the heel region.

Clause 88. The footwear upper of clause 80, wherein: a first number of the first zones are in the midfoot region and each are of a first width; a second number of the first zones are in the heel region and each are of a second width greater than the first width.

Clause 89. The footwear upper of clause 80, wherein: the knit outer face layer comprises a mesh pattern including first knitted-in holes of a first size; and the knit inner face layer comprises a mesh pattern including second knitted-in holes of a second size larger than the first size and overlapping with the first knitted-in holes.

Clause 90. The footwear upper of clause 89, wherein a surface of the knit outer face layer is smoother than a surface of the knit inner face layer at each of the first zones and at each of the second zones.

Clause 91. The footwear upper of clause 89, wherein: the first knitted-in holes of the knit outer face layer each have a first maximum length in the longitudinal direction; the second knitted-in holes of the knit inner face layer each have a second maximum length in the longitudinal direction; and the second maximum length is from about two to about four times the first maximum length.

Clause 92. The footwear upper of clause 91, wherein the second maximum length is greater than a maximum width of each of the second knitted-in holes such that the modulus of elasticity of the unitary knit structure in the second zones is greater in the longitudinal direction than in a transverse direction.

Clause 93. The footwear upper of clause 73, wherein the knit outer face layer comprises one or more monofilament yarns and the knit inner face layer comprises one or more multi-filament yarns.

Clause 94. The footwear upper of clause 93, wherein the knit outer face layer consists of the one or more monofilament yarns and the knit inner face layer consists of the one or more multi-filament yarns.

Clause 95. The footwear upper of clause 93, wherein the knit intermediate layer comprises one or more multi-filament yarns.

Clause 96. The footwear upper of clause 73, wherein the knit inner face layer comprises one or more recycled drawn polyester multi-filament yarns.

Clause 97. The footwear upper of clause 96, wherein the knit outer face layer comprises one or more drawn polyester monofilament yarns.

Clause 98. The footwear upper of clause 73, wherein the knit outer face layer comprises one or more multi-filament yarns.

Clause 99. The footwear upper of clause 73, wherein the knit inner face layer, the knit outer face layer, and the knit intermediate layer comprise yarns recyclable by melting the yarns and re-extruding melted material of the melted yarns.

Clause 100. The footwear upper of clause 73, wherein: the knit outer face layer comprises drawn polyester monofilament yarns; the knit inner face layer comprises drawn polyester multi-filament yarns; and the knit intermediate layer comprises cationic dyed polyester yarns.

Clause 101. The footwear upper of clause 73, wherein the unitary knit structure is substantially free of yarn comprising a thermoset material.

Clause 102. An article of footwear comprising: a footwear upper according to any of clauses 1-101, and a sole structure directly secured to an outer surface of the knit outer face layer of the footwear upper.

Clause 103. A method of manufacturing a footwear upper, the method comprising: simultaneously knitting a footwear upper including a knit outer face layer, a knit inner face layer, and a knit intermediate layer with one another to define a unitary knit structure having a forefoot region, a midfoot region, and a heel region of a footwear upper; wherein the knit intermediate layer is disposed between the knit outer face layer and the knit inner face layer at a plurality of first zones and absent from or present in a lesser amount or density in a plurality of second zones, the first zones alternating with the second zones in a direction configured to be a longitudinal direction of an article of footwear when the footwear upper is used in an article of footwear, and the unitary knit structure having a greater modulus of elasticity in the longitudinal direction in the first zones than in the second zones, and having greater breathability in the second zones than in the first zones.

Clause 104. The method of clause 103, wherein the footwear upper is a footwear upper according to any of clauses 1-101.

Clause 105. A footwear upper manufactured according to any of clauses 103-104.

Clause 106. An article of footwear comprising a footwear upper manufactured according to any of clauses 103-104.

Clause 107. A method of manufacturing an article of footwear, the method comprising: affixing a footwear upper according to any of clauses 1-101, and a sole structure, wherein the affixing comprises directly securing an outer surface of the knit outer face layer of the footwear upper to the sole structure.

Clause 108. An article of footwear manufactured according to the method of clause 107.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" particularly refers to a direction extending a length of a component. For example, a longitudinal direction of a shoe extends between a forefoot region and a heel region of the shoe. The term "forward" or "anterior" is used to particularly refer to the general direction from a heel region toward a forefoot region, and the term "rearward" or "posterior" is used to particularly refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" particularly refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical" particularly refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" particularly refers to the vertical direction pointing towards a top of the component, which may include an instep, a fastening region and/or a throat of an upper. The term "downward" or "downwards" particularly refers to the vertical direction pointing opposite the upwards direction, toward the bottom of a component and may generally point towards the bottom of a sole structure of an article of footwear.

The "interior" of an article of footwear, such as a shoe, particularly refers to portions at the space that is occupied by a wearer's foot when the shoe is worn. The "inner side" of a component particularly refers to the side or surface of the component that is (or will be) oriented toward the interior of the component or article of footwear in an assembled article of footwear. The "outer side" or "exterior" of a component particularly refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" particularly refer to the direction toward the interior of the component or article of footwear, such as a shoe, and the terms "outward" and "outwardly" particularly refer to the direction toward the exterior of the component or article of footwear, such as the shoe. In addition, the term "proximal" particularly refers to a direction that is nearer a center of a footwear component or is closer toward a foot when the foot is inserted in the article of footwear as it is worn by a user. Likewise, the term "distal" particularly refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. A footwear upper comprising:

a unitary knit structure having:

a knit outer face layer disposed at an outer side of the unitary knit structure when assembled in an article of footwear;

a knit inner face layer disposed at an inner side of the unitary knit structure and facing a foot-receiving cavity when assembled in the article of footwear; and a knit intermediate layer;

wherein the knit outer face layer, knit inner face layer, and knit intermediate layer are integrally knit with one another to define a forefoot region, a midfoot region, and a heel region of the footwear upper;

wherein the knit intermediate layer is disposed between the knit outer face layer and the knit inner face layer and is different at a plurality of first zones of the unitary knit structure than at a plurality of second zones of the unitary knit structure;

wherein the first zones alternate with the second zones in a longitudinal direction of the footwear upper;

wherein the knit outer face layer includes a first plurality of yarns, the knit inner face layer includes a second plurality of yarns separate and distinct from the first plurality of yarns, the first plurality of yarns are not included in the knit inner face layer and the second plurality of yarns are not included in the knit outer face layer;

wherein the knit outer face layer comprises a mesh pattern including first knitted-in holes of a first size;

wherein perimeters of the first knitted-in holes are defined by the first plurality of yarns and not by the second plurality of yarns;

wherein the knit inner face layer comprises a mesh pattern including second knitted-in holes of a second size larger than the first size and overlapping with the first knitted-in holes;

wherein perimeters of the second knitted-in holes are defined by the second plurality of yarns and not by the first plurality of yarns;

wherein the knit outer face layer does not include the second knitted-in holes and the knit inner face layer does not include the first knitted-in holes;

wherein an average fore-aft width of the first zones in the heel region is greater than an average fore-aft width of the first zones in the forefoot region; and wherein an average fore-aft width of the second zones in the forefoot region is greater than an average fore-aft width of the second zones in the heel region.

2. The footwear upper of claim 1, wherein the knit outer face layer and the knit inner face layer are connected in the first zones and the second zones.

3. The footwear upper of claim 1, wherein boundaries between adjacent ones of the first zones and the second zones extend substantially linearly in a transverse direction of the footwear upper.

4. The footwear upper of claim 3, wherein:

the first zones progressively increase in fore-aft width in a rearward direction at least from the forefoot region to the midfoot region; and the second zones progressively increase in fore-aft width in a forward direction at least from the midfoot region to the forefoot region.

5. The footwear upper of claim 1, wherein an average fore-aft width of the first zones in the midfoot region is less than an average fore-aft width of the first zones in the heel region.

6. The footwear upper of claim 1, wherein the unitary knit structure is more transparent or more translucent at the second zones than at the first zones.

7. The footwear upper of claim 6, wherein the knit outer face layer is more transparent or more translucent than the knit inner face layer and the knit intermediate layer.

8. The footwear upper of claim 1, wherein:

the first knitted-in holes of the knit outer face layer each have a first maximum length in a longitudinal direction of the article of footwear;

the second knitted-in holes of the knit inner face layer each have a second maximum length in the longitudinal direction; and the second maximum length is from about two to about four times the first maximum length.

9. The footwear upper of claim 1, wherein the first plurality of yarns of the knit outer face layer and/or the second plurality of yarns of the knit inner face layer comprises multi-filament yarns.

10. The footwear upper of claim 1, wherein the knit intermediate layer comprises one or more multi-filament yarns.

11. The footwear upper of claim 1, wherein the second plurality of yarns of the knit inner face layer, the first plurality of yarns of the knit outer face layer, and yarns of the knit intermediate layer comprise yarns recyclable by melting the yarns and re-extruding melted material of the melted yarns.

12. The footwear upper of claim 1, wherein the unitary knit structure is substantially free of yarn comprising a thermoset material.

13. The footwear upper of claim 1, wherein the knit intermediate layer is absent from the second zones.

14. The footwear upper of claim 1, wherein knit intermediate layer is present in a lesser amount in the second zones than in the first zones.

15. The footwear upper of claim 1, wherein the knit intermediate layer has a lesser density in the second zones than in the first zones.

16. The footwear upper of claim 1, wherein the knit intermediate layer includes a greater number of yarn ends per unit area in the first zones than in the second zones.

17. The footwear upper of claim 1, wherein the knit inner face layer and the knit outer face layer are coextensive, one-piece layers, each extending to and defining an entire outer perimeter of the unitary knit structure including a medial edge, a lateral edge, a rear edge, and a front edge and each characterized by an absence of sewn seams.

18. The footwear upper of claim 1, in combination with a sole structure directly secured to an outer surface of the knit outer face layer.

19. The footwear upper of claim 1, wherein the knit inner face layer consists of the second plurality of yarns at the perimeters of the second knitted-in holes in the second zones.

* * * * *